US011957231B2

(12) United States Patent
Novikov et al.

(10) Patent No.: US 11,957,231 B2
(45) Date of Patent: Apr. 16, 2024

(54) COSMETIC APPLICATOR AND METHOD OF USING SAME

(71) Applicant: Ingenious Inventions, Inc., Old Bridge, NJ (US)

(72) Inventors: Irina Novikov, Old Bridge, NJ (US); Boris Vernovsky, Old Bridge, NJ (US)

(73) Assignee: INGENIOUS INVENTIONS, INC., Old Bridge, NJ (US)

( * ) Notice: Subject to any disclaimer, the term of this patent is extended or adjusted under 35 U.S.C. 154(b) by 206 days.

(21) Appl. No.: 16/762,374

(22) PCT Filed: Nov. 8, 2018

(86) PCT No.: PCT/US2018/059741
§ 371 (c)(1),
(2) Date: May 7, 2020

(87) PCT Pub. No.: WO2019/094539
PCT Pub. Date: May 16, 2019

(65) Prior Publication Data

US 2021/0037951 A1 Feb. 11, 2021

Related U.S. Application Data

(60) Provisional application No. 62/583,249, filed on Nov. 8, 2017.

(51) Int. Cl.
*A45D 40/26* (2006.01)
*A45D 33/00* (2006.01)
(Continued)

(52) U.S. Cl.
CPC ..... *A45D 40/262* (2013.01); *A45D 33/00* (2013.01); *A45D 34/042* (2013.01);
(Continued)

(58) Field of Classification Search
CPC .... A45D 40/262; A45D 33/00; A45D 34/042; A45D 2200/1018; A45D 2200/1072;
(Continued)

(56) References Cited

U.S. PATENT DOCUMENTS 173,879 A * 2/1876 Anderson ..... A47L 13/24 15/144.2
239,660 A * 4/1881 Hurlburt ..... A46B 7/04 403/233
(Continued)

FOREIGN PATENT DOCUMENTS

CN 102176844 A 9/2011
CN 202874259 U * 4/2013
(Continued)

OTHER PUBLICATIONS

Wang Liduan, "CN 206896034 U_translated" (Year: 2018).*
(Continued)

*Primary Examiner* — Jacqueline T Johanas
*Assistant Examiner* — Holly T. To
(74) *Attorney, Agent, or Firm* — Amster, Rothstein & Ebenstein LLP

(57) ABSTRACT

A cosmetic application device includes an application member and a positioning support system therefore which provides improved accuracy and side-to-side repeatability for the application of a cosmetic. The application member is optionally adjustable and repositionable relative to the positioning support system and may be further optionally provided in a kit form with one or more colorant members, guide members or replacement application members. A method for using the proposed invention is provided.

19 Claims, 24 Drawing Sheets

(51) Int. Cl.
*A45D 34/04* (2006.01)
*A46B 5/00* (2006.01)
*A46B 9/02* (2006.01)

(52) U.S. Cl.
CPC ..... *A46B 5/0012* (2013.01); *A46B 5/0016* (2013.01); *A46B 9/021* (2013.01); *A45D 2200/1018* (2013.01); *A45D 2200/1072* (2013.01); *A45D 2200/25* (2013.01); *A46B 2200/1046* (2013.01)

(58) Field of Classification Search
CPC .. A45D 2200/25; A45D 34/04; A45D 34/045; A45D 40/26; A45D 40/261; A45D 40/265; A45D 40/28; A45D 2/48; A45D 2200/10; A45D 2200/1009; A45D 40/24; A45D 40/20; A45D 2040/0012; A46B 5/0012; A46B 5/0016; A46B 9/021; A46B 2200/1046; A46B 5/0004; A46B 5/0008; A46B 5/002; A46B 5/0033; A46B 5/0041; A46B 5/0045; A46B 5/0054; A46B 5/0058; A46B 5/0083; A46B 5/095; A46B 9/023; A46B 2200/10; A46B 2200/1013; A46B 2200/1053; A46B 9/04; A46B 9/045; A46B 2200/1026; A46B 2200/1066; A46B 2200/1073; A46B 2200/1093; A46B 5/005; A46B 5/0087; A36B 5/0012
USPC ..... 132/317; 15/1.52
See application file for complete search history.

(56) References Cited

U.S. PATENT DOCUMENTS 328,426 A * 10/1885 Nowlin ..... A46B 17/08 15/166
541,727 A * 6/1895 Dennis ..... A46B 5/0075 403/138
545,691 A * 9/1895 Howland ..... A46B 5/0075 15/172
655,833 A * 8/1900 Roth ..... A46B 7/06 15/201
857,239 A * 6/1907 Hawkins ..... A46B 17/08 15/166
1,004,438 A * 9/1911 King ..... A46B 17/08 15/166
1,405,712 A * 2/1922 Lewis ..... A46B 5/0075 15/144.1
1,458,074 A * 6/1923 Pikoos ..... A46B 9/04 15/167.1
1,595,901 A * 8/1926 Mahler ..... A46B 5/0075 15/144.1
1,697,756 A * 1/1929 Curran ..... A46B 17/08 15/166
1,709,262 A * 4/1929 Henderhan ..... A46B 9/045 15/167.2
1,748,895 A * 2/1930 Philip ..... A46B 9/045 15/203
1,787,970 A * 1/1931 Bertola ..... A46B 5/0083 15/144.2
1,905,399 A * 4/1933 Wagner ..... A45D 2/48 15/160
2,116,406 A * 5/1938 Nancarrow ..... A43D 95/06 15/166
2,232,269 A * 2/1941 Reuben ..... A46B 5/0075 15/167.1
2,236,240 A * 3/1941 Lowen ..... A45D 40/18 401/99
2,246,773 A * 6/1941 Adams ..... A46B 17/06 15/201
2,749,567 A * 6/1956 Krueger ..... A46B 13/08 15/172
2,753,839 A * 7/1956 Clark ..... F01M 11/00 118/410
2,888,008 A * 5/1959 Rosenthal ..... A61H 13/00 132/309
3,188,672 A * 6/1965 Gary ..... A46B 5/0025 15/201
3,320,962 A * 5/1967 Moriber ..... A45D 40/20 D28/7
3,691,587 A * 9/1972 Makowsky ..... A46B 7/02 15/167.1
4,020,521 A * 5/1977 Velasquez ..... A46B 7/02 15/176.4
4,211,247 A * 7/1980 Morganroth ..... A45D 7/04 132/270
4,398,800 A * 8/1983 Hayes ..... G02B 25/005 359/809
4,662,385 A * 5/1987 Schefer ..... A45D 34/04 132/218
4,731,896 A * 3/1988 de La Tour ..... A46B 5/0075 403/93
4,807,324 A * 2/1989 Owens ..... A46B 5/0012 15/166
4,807,824 A 2/1989 Gains et al.
4,842,132 A * 6/1989 Wells ..... G02B 27/0006 206/229
4,879,781 A * 11/1989 Desimone ..... A61H 13/00 403/93
D325,791 S 4/1992 Cassai
5,107,984 A * 4/1992 Welschoff ..... A45C 13/345 206/823
5,109,563 A * 5/1992 Lemon ..... A46B 9/04 15/167.1
5,205,302 A * 4/1993 Lemon ..... A46B 5/0083 132/321
5,228,466 A * 7/1993 Klinkhammer .... A46B 15/0071 132/308
5,309,596 A 5/1994 Simms
5,319,824 A * 6/1994 Cook, III ..... A46B 7/04 15/160
D350,424 S * 9/1994 Elliott ..... 15/210.1
5,350,248 A * 9/1994 Chen ..... A46B 9/04 401/145
5,377,377 A 1/1995 Bredall et al.
5,502,859 A * 4/1996 Kim ..... A46B 5/0083 403/53
5,611,361 A * 3/1997 Leone ..... A46B 9/021 132/142
5,758,380 A * 6/1998 Vrignaud ..... A46B 15/0081 15/106
5,765,573 A * 6/1998 Gueret ..... A45D 40/28 206/823
5,791,007 A * 8/1998 Tsai ..... A46B 5/0083 15/201
5,842,249 A * 12/1998 Sato ..... A46B 5/0008 15/207.2
5,903,950 A * 5/1999 Lavin ..... A46B 5/0083 15/160
5,934,295 A * 8/1999 Gekhter ..... A61C 15/048 132/309
5,940,924 A * 8/1999 Williams ..... A47L 13/12 15/118
5,960,509 A * 10/1999 Wu ..... A46B 17/02 403/93
5,974,618 A * 11/1999 Dumler ..... A61C 15/00 15/167.1
5,988,917 A * 11/1999 Sheffler ..... A45D 40/06 401/78
6,015,293 A * 1/2000 Rimkus ..... A46B 15/0055 433/141
6,026,825 A * 2/2000 de Laforcade ..... A46B 3/18 401/122
D423,784 S 5/2000 Joulin
6,076,221 A * 6/2000 Bradshaw ..... A46B 7/04 15/176.1

(56) References Cited

U.S. PATENT DOCUMENTS 6,219,874 B1 * 4/2001 van Gelder ..... A46B 5/0025 15/201
6,237,194 B1 * 5/2001 Williams ..... B43L 15/00 30/298
6,247,477 B1 * 6/2001 Wagner ..... A45D 44/18 132/309
6,514,445 B1 * 2/2003 Cann ..... A46B 5/0025 264/273
7,757,333 B2 * 7/2010 Battaglia ..... A46B 9/026 15/201
7,955,018 B2 6/2011 Abergel
8,117,707 B1 * 2/2012 Ruh, II ..... A46B 5/0075 15/160
8,375,960 B1 * 2/2013 Pheng ..... A45D 29/00 132/73.5
8,448,287 B2 * 5/2013 Ponzini ..... A61C 17/222 15/176.1
D700,437 S 3/2014 Hohlbein et al.
9,167,882 B2 * 10/2015 Stefanson ..... A61C 15/00
D757,443 S 5/2016 Waitesmith
9,578,955 B2 2/2017 Kim et al.
9,642,441 B1 * 5/2017 Ajootian ..... A45D 40/28
D809,304 S 2/2018 Tsukamoto
D838,496 S 1/2019 Lin
10,349,729 B1 * 7/2019 Cheema ..... A46B 9/021
10,398,215 B2 * 9/2019 Kim ..... A45D 34/04
D869,173 S * 12/2019 Ossai ..... D4/119
D880,168 S 4/2020 Staab
10,610,005 B2 * 4/2020 Kim ..... A46B 9/021
10,709,226 B2 * 7/2020 Tarling ..... A46B 9/021
D901,184 S * 11/2020 Novikov ..... D4/121
10,932,557 B2 * 3/2021 To ..... A46B 15/0073
11,241,078 B2 * 2/2022 Zwimpfer ..... A46B 5/021
11,672,321 B2 * 6/2023 Dempsey ..... A45D 40/265 132/200
2001/0054211 A1 * 12/2001 Cabedo-Deslierres ..... A46B 5/0016 132/309
2002/0020425 A1 * 2/2002 Dorsa ..... A45D 40/18 132/218
2002/0073496 A1 * 6/2002 Kim ..... A46B 5/0016 132/309
2004/0009028 A1 * 1/2004 Gueret ..... A45D 40/265 401/122
2004/0168700 A1 * 9/2004 Dorf ..... A45D 33/00 132/313
2004/0187242 A1 * 9/2004 Hitzler ..... A46B 5/0075 15/172
2006/0013639 A1 * 1/2006 Gueret ..... A45D 34/045 401/122
2006/0137122 A1 * 6/2006 Ryan ..... A46B 17/04 15/184
2007/0157406 A1 * 7/2007 Kim ..... A46B 5/0075 15/144.1
2007/0251041 A1 * 11/2007 Errichiello ..... B05C 17/022 15/230.11
2008/0006287 A1 * 1/2008 Gueret ..... A45D 40/265 132/294
2010/0132731 A1 6/2010 Waitesmith
2010/0147318 A1 6/2010 Azar
2010/0329770 A1 * 12/2010 Volek ..... A45D 34/045 401/6
2011/0113576 A1 * 5/2011 Yankell ..... A46B 9/045 15/167.2
2011/0135376 A1 6/2011 Weigel et al.
2011/0174328 A1 7/2011 Cerutti et al.
2012/0017930 A1 * 1/2012 Nance ..... A45D 19/012 132/120
2012/0045268 A1 * 2/2012 Geuther ..... A45D 33/14 401/121
2013/0074868 A1 3/2013 Shimamura
2014/0099152 A1 4/2014 Hatch
2014/0109927 A1 4/2014 Simard
2014/0109928 A1 * 4/2014 Simard ..... A45D 40/265 132/200
2014/0208533 A1 * 7/2014 Lim ..... A46B 5/0016 15/144.1
2015/0055999 A1 * 2/2015 Lim ..... A46B 5/0041 401/125
2015/0223592 A1 * 8/2015 Heintschel ..... A46B 5/005 15/144.4
2016/0128447 A1 * 5/2016 Lim ..... A45D 34/042 132/317
2016/0316888 A1 * 11/2016 Moon ..... A46B 5/0012
2016/0367013 A1 * 12/2016 Arredondo ..... A45D 40/265
2017/0055677 A1 3/2017 Bowers et al.
2017/0231368 A1 * 8/2017 Navarro ..... A45D 40/18 132/218
2018/0072092 A1 * 3/2018 Hilton Dunne .... A46B 15/0097
2018/0116373 A1 * 5/2018 Zhan ..... A45D 34/045
2019/0008272 A1 * 1/2019 Torno ..... A45C 11/24
2020/0281341 A1 * 9/2020 Park ..... A45D 34/042
2022/0192353 A1 * 6/2022 Song ..... A46B 7/048

FOREIGN PATENT DOCUMENTS

CN 203538671 U * 4/2014
CN 104414109 A * 3/2015 ..... A45D 34/045
CN 206499092 U * 9/2017
CN 206896034 U * 1/2018
CN 207041185 U * 2/2018
CN 213992805 U * 8/2021
DE 4225546 A1 * 2/1994 ..... A46B 5/0016
DE 202010010860 U1 * 12/2011 ..... A45D 33/14
DE 202019003796 U1 * 1/2020
EP 1145662 A2 * 10/2001 ..... A45D 34/06
EP 2380456 A1 * 10/2011 ..... A45D 34/04
EP 2 888 972 A1 7/2015
EP 2 915 447 A 9/2015
FR 627418 A * 10/1927 ..... A46B 5/0016
FR 694605 A * 12/1930
FR 2138237 A1 * 1/1973
FR 2464674 A1 * 3/1981 ..... A46B 5/0016
FR 2752150 A1 * 2/1998 ..... A46B 5/0016
GB 417028 A * 9/1934
GB 802571 A * 10/1958
GB 2192784 A * 1/1988 ..... A46B 5/0012
JP 852-122872 U 9/1977
JP 3037696 B1 * 4/2000 ..... A46B 15/0071
JP 2004113378 A * 4/2004 ..... A46B 5/0054
JP 2007020793 A 2/2007
JP 2011-115589 A 6/2011
JP 2016-505286 A 2/2016
JP 2018122060 A * 8/2018
KR 200167994 Y1 * 2/2000
KR 200406850 Y1 * 1/2006
KR 20070098424 A 10/2007
KR 20100036660 A * 4/2010
KR 200470287 Y1 * 12/2013 ..... A45D 33/14
KR 20160149661 A * 12/2016
KR 20170069102 A * 6/2017
KR 102139430 B1 * 7/2020
NO 152318 B * 6/1985
WO WO-9836661 A1 * 8/1998 ..... A46B 15/0071
WO WO-2019094539 A1 * 5/2019 ..... A45D 2/48
WO WO-2020105937 A1 * 5/2020 ..... A46B 5/0008

OTHER PUBLICATIONS

Bergeaud, "FR_2752150_A1_Translated" (Year: 1998).*
International Search Report issued in Counterpart PCT Application No. PCT/US2018/059741.
Written Opinion issued in issued in Counterpart PCT Application No. PCT/US2018/059741.
Communication Supplementary European Search Report dated Jun. 2, 2021 in connection with European Patent Application No. 18875261.2.
United States Patent and Trademark Office, "Notice of Allowance and Fee(s) Due," issued in U.S. Appl. No. 29/664,400, dated Jul. 13, 2020, 6 pages.

(56) References Cited

OTHER PUBLICATIONS

Japan Patent Office, "Preliminary Notice of Reasons for Rejection", issued in Japanese Patent Application No. 2020-544588, which is a counterpart to U.S. Appl. No. 16/762,374, dated Nov. 8, 2022, 9 pages (5 pages of Translation of Office Action and 4 pages of original Office Action).
China National Intellectual Property Administration, "First Office Action", issued in Chinese Application No. 201880085766.0, which is a counterpart to U.S. Appl. No. 16/762,374, dated Nov. 9, 2022, 7 pages.
China National Intellectual Property Administration, "Search Report", issued in Chinese Application No. 201880085766.0, which is a counterpart to U.S. Appl. No. 16/762,374, dated Nov. 9, 2022, 3 pages.
Serviço Público Federal Ministério Da Economia Instituto Nacional Da Propriedade Industrial, "Search Report", issued in Brazilian Patent Application No. 112020009146-4, which is a counterpart to U.S. Appl. No. 16/762,374, dated Sep. 7, 2022, 4 pages.
Brazilian Office Action dated Jan. 17, 2024 in Respect to Counterpart Brazilian Patent Application No. BR 11 2020 009146-4 and its English Translation.

* cited by examiner

DIAMOND BRUSH POSITION CHANGES WHEN APPLYING MAKEUP ON LEFT EYELID AND RIGHT EYELID. IT ALWAYS STARTS AT ONE END OF THE ALMOND BRUSH

SHOWS HOW DIAMOND BRUSH IS TURNED 180 DEGREES AWAY TO FINISH ALMOND BRUSH MAKEUP

STEP 5: USE DIAMOND BRUSH FOR UNDER EYELASH MAKEUP LINE

STEP 6: USE BLENDER BRUSH TO BLEND MAKEUP. SEE EX

COSMETIC APPLICATOR AND METHOD OF USING SAME

CROSS REFERENCE TO RELATED APPLICATIONS

This application is a National Stage entry under 35 U.S.C. 371 of International Patent Application No. PCT/US2018/059741, filed on Nov. 8, 2018, which claims the benefit of and priority to U.S. Provisional Patent Application No. 62/583,249, filed on Nov. 8, 2017, the entire contents of which are incorporated by reference herein.

FIELD OF THE INVENTION

The present invention relates to a cosmetic application device and related and alternative systems, kits, and methods of use. More particularly, the present invention provides an apparatus for the adaptive and precise application of eye enhancement indicia including use of eye liner, eye crease, and eyebrow colorant.

DESCRIPTION OF THE RELATED ART

Commercial devices exist for the application of colorant indicia on a user's eye lid, eye-crease-area, and eyebrow, as will be understood by those of skill in the art. Conventionally, these are provided in an elongate cylindraceous form (e.g., pencil) or in an elongate brush-or-pad form with a handle (e.g., an applicator). Such consumer items may be in any color indicia along the color spectrum and would include conventional makeup colors as well as decorative, ornamental, or entertainment colors across a spectrum of blended colors. Conventionally, such consumer items are selected by a user for color indicia preference. The colors and tones are wide spread but will be understood by those of skill in the art to be unlimited, and will include as a non-limiting example, every color and tone combination in the PANTONE® COLOR SPECFIER provided by Pantone, Inc.

Referring now to FIG. 1 conventionally understood features of a user 1 will be discussed for as will be understood by those of skill in the art. Users 1 include respective eyebrows 2, 2, and brow ridges 3, 3 indicating the underlying bone structure for each user 1, with respective eyes 4, 4 and a nose 5 having a nose bridge 5*a* above a mouth 6 and a chin boss 7 positioned on a face midline 14 which bisects a user's facial arrangement.

Chin boss 7 will be understood to be the recent of the chin of a user 1. Each cheek bone center 8, 8 is provided and is also understood to be the main arcuate apex of the cheek bone of a user 1. Respective eye cover folds 9, 9 extend above the actual eye 4, 4, of each user and may have varying structures that differ depending upon the user 1. Each eye cover fold 9 will be understood to be the skin portion above each eye 4 before reaching a respective eyebrow 2. Below each eye 4, 4, is a respective eye lower fold 10, 10 which will be understood generally as the skin portion below each eye 4 before reaching a respective cheek bone center 8. Each cover fold 9 and each lower fold 10 may vary by size, contour, shape, and texture by a user.

Each eye 4 has a respective lower eye lid contact surface 11 and an opposed upper eye lid contact surface 12. Each eye 4 is understood to have a respective inner edge 4*a* (proximate the closing fold of each user's eye and the user's tear duct, medial canthus region) and a respective outer edge 4*b* (proximate the closing fold of each eye 4).

It will be understood that eye lid contact surfaces 11, 12 are the 'closing contact' surfaces that include the actual eye-lashes (shown but not numbered). Various users 1 may include, or not, one or more eyelid creases 13 (one crease 13 is shown above each eye, but there may be no crease or multiple creases) as will be understood by those of skill in the art.

As is understood in the art, various makeup products are applied to the eye cover folds 9, lower eye folds 10, and respective lower and upper lid contact surface 11, 12 in a conventional manner.

Referring now to FIG. 2, user 1 demonstrates an exemplary conventional application of a conventional makeup pencil 15 having a tip end 16 upon a portion of eye cover fold 9 region just above a user's eyelashes. As shown, this process requires an awkward two-handed use for each side (left/right) relative to a user's eyes 4, 4. As shown, user 1 is using pencil 15 in a free-hand manner and in combination with a user's other hand as a sort of skin-pulling technique (to straighten the eyelid cover fold 9 to allow a linear-line drawn) to create an 'applying' form arrangement (form in which makeup is applied). A linear line is recognized as the easiest kind of line to draw in a free-hand manner. Unfortunately, upon the user relaxing her hands, the eye cover fold 9 of each eye 4 will return to the user's natural shape. With practice a user can estimate a desired 'final' form based upon an 'applying form.' Unfortunately, there are many difficulties in accurately predicting a'final' form based on an 'applying form' for each application by a user when using free-hand techniques.

As shown in FIGS. 3 and 4 further exemplary views of conventional application steps for makeup are provided using a free-hand, two-handed, or one-handed technique. In FIG. 3 a user's two-handed technique applies a makeup flair 15*a* while a finger stretches (see arrows) the eye cover fold 9 into a linear form. In FIG. 4, a user's two-handed technique applies a makeup brush 15*b* to the lower eyelid fold 10 proximate lower eyelid contact surface 11 while using a one-hand technique and a finger (shown) positioned at a random point on a user's cheek region. In FIG. 4 a crease 13 is shown that is generally parallel and clearly defined providing a'shadow' effect to the upper eye lid and within the eye cover fold 9 between eye 4 and eyebrow 2.

Overall, it is recognized that accurate and repeatable application of eye-related cosmetics is particularly difficult in the art and that no satisfactory solution has been provided using a free-hand or single-hand method.

FIG. 5 is a graphical illustration of alternative eye-lid creases noting a wide variety eye and lid shapes. As noted, user's eye lid-upper eye cover folds 9 may be shaped with no crease 13, with tapering creases, lateral flairs, parallel creases, or even multiple creases 13. It will be understood that wide variety exists in facial features.

In FIG. 6 a further variety of eye cover fold 9 is provided having an extending skin fold (epicanthic fold) which provides a hidden or rolled-over crease 13 that may extend, in this case, from inner edge 4*a* to outer edge 4*b*. This variety of eye cover fold 9 may also occur in a person with non-elastic or sagging skin on their upper cover eye region 9.

Those of skill in the art will recognize that application of makeup, by hand, is particularly difficult to repeat side-to-side. Those of skill in the art will additionally recognize that it is further difficult to accurately pursue side-to-side accuracy when a user (for example a user in FIG. 5 or 6) attempts to artificially insert a visually-seen cosmetic crease where their eye-structure does not naturally include a crease 13 (for example a natural crease is noted in FIG. 4), for reasons of a fashion preference.

It is additionally recognized that cosmetic users have attempted to address the difficulty of repetitive accuracy in makeup application through the use of physical apparatus. This is most commonly used in darkening a user's eyebrows since the eyebrows are most easily positioned on the underlying brow ridge 3 structures of each user. Examples of such cosmetic eyebrow applicators are shown in US Pub. No. 2016/0360861 (Shimley et al.) and U.S. Pat. No. 8,051,860 (Pereira), the contents of which are fully incorporated herein by reference.

Accordingly, there is a need for an improved eye-focus-makeup applicator arrangement and method for using the same that addresses at least one of the needs noted above. Further, there is also a need to improve the method of eyefocused cosmetic application that increases side-to-side accuracy and minimizes the negative impacts of a user's own structure in the eye cover fold region.

SUMMARY OF THE INVENTION

In response, it is now recognized that there is at least one need in the conventional arts. As a result, the present invention provides a cosmetic application device includes an application member and a positioning support system therefore which provides improved accuracy and side-to-side repeatability for the application of a cosmetic. The application member is optionally adjustable and repositionable relative to the positioning support system and may be further optionally provided in a kit form with one or more colorant members, guide members or replacement application members. A method for using the invention and adjustment of the invention is provided.

According to one exemplary embodiment of the present invention, there is provided a cosmetic system, comprising an elongate positioning support system adjustably secured to an application member; at least one of the elongate positioning support system and the application member comprising means for replaceably receiving one of a plurality of tip end members; and the elongate positioning system comprising means for adaptively securing the application member whereby the tip end member is adjustably positioned relative to a distal end member of the cosmetic system.

According to another exemplary embodiment of the present invention, there is provided an applicator member having a plurality of tip end members, each tip end member being angularly adjustable relative to an elongate handle portion of said applicator member.

According to another exemplary embodiment of the present invention, there is provided an adaptive kit assembly comprising a plurality of tip members, a positioning support system having at least one applicator member, a supporting face bridge member and a supporting chin rest member.

According to another exemplary embodiment of the invention, an adaptable cosmetic system comprises: an elongate positioning support system adjustably secured to an application member; at least one of said elongate positioning support system and said application member comprising means for replaceably receiving one of a plurality of tip end members; and said elongate positioning system comprising means for adaptively securing said application member whereby said tip end member is adjustably positioned relative to a distal end member of said cosmetic system.

According to another exemplary embodiment of the invention, an adaptable cosmetic system, comprises: an elongate positioning support system adjustably secured to an application member; at least one of said elongate positioning support system and said application member comprising means for receiving a tip end members; and said elongate positioning system comprising means for adaptively securing said application member whereby said tip end member is adjustably positioned relative to a distal end member of said cosmetic system.

The above and other aspects, features and advantages of the present invention will become apparent from the following description read in conjunction with the accompanying drawings, in which like reference numerals designate the same elements.

DETAILED DESCRIPTION

Figure 1:
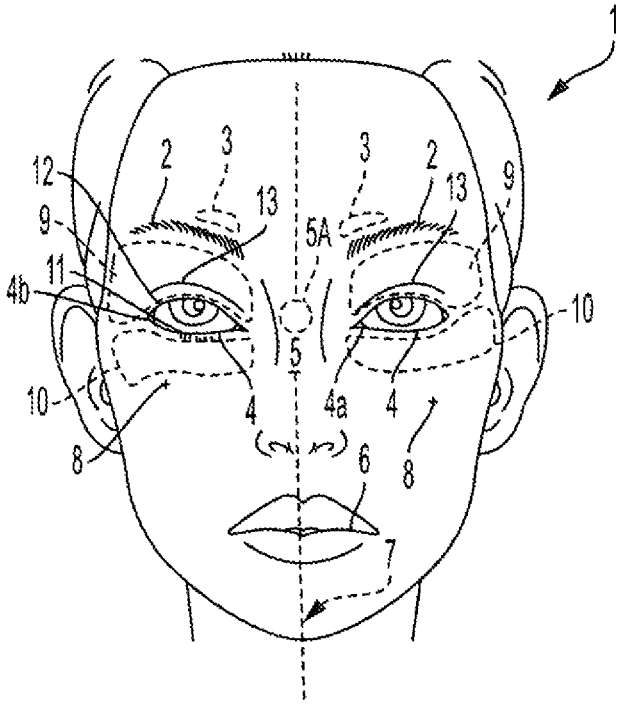
FIG. 1 PRIOR ART
FIG. 1 is a representational illustration of the facial structure of a user noting particular points of conventional detail.
Figure 2:
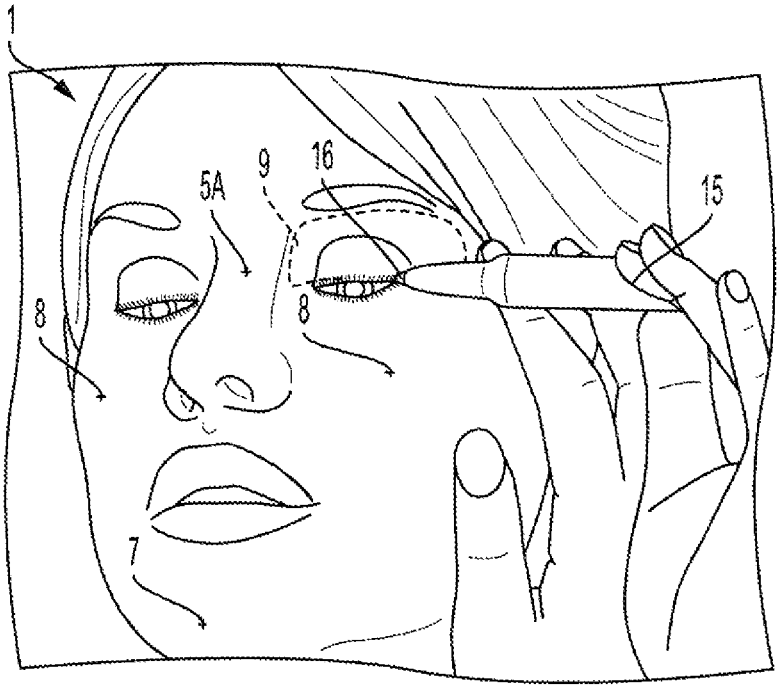
FIG. 2 PRIOR ART
FIG. 2 is a graphical illustration of a conventional application of eyeliner employing a two-hand guiding technique and a flair (or felt) tip type applicator.
Figure 3:
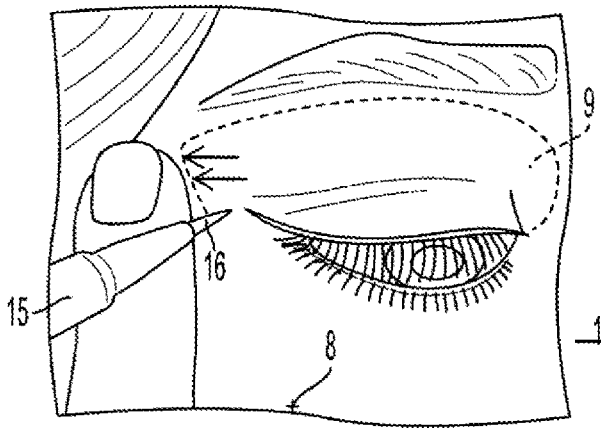
FIGS. 3 and 4 are graphical exemplary views of conventional application steps for makeup using a free-hand two-handed (FIG. 3) or one-handed (FIG. 4) technique.
Figure 4:
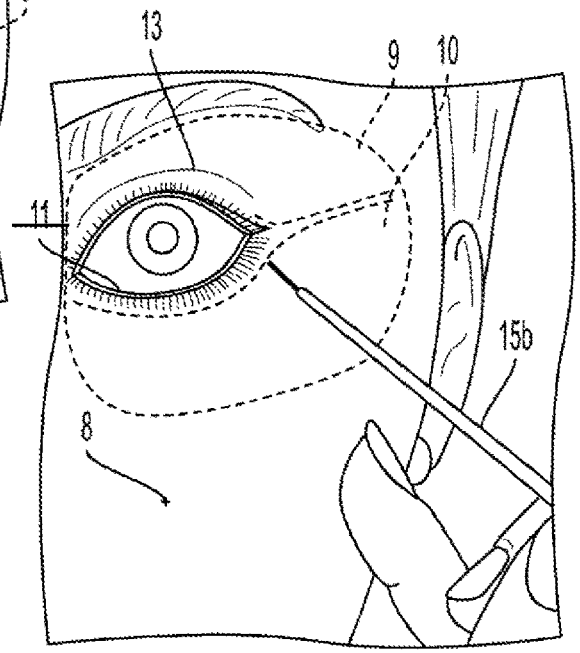

Reference will now be made in detail to embodiments of the invention. Wherever possible, same or similar reference numerals are used in the drawings and the description to refer to the same or like parts or steps. The drawings are in simplified form and are not to precise scale. The word 'couple' or 'fix' or 'secure' and similar terms do not necessarily denote direct and immediate connections, but also include connections through intermediate elements or devices. For purposes of convenience and clarity only, directional (up/down, etc.) or motional (forward/back, left/right etc.) terms may be used with respect to the drawings. These and similar directional terms should not be construed to limit the scope in any manner. It will also be understood by those of skill in the art that other embodiments may be utilized without departing from the scope of the present invention, and that the detailed description is not to be taken in a limiting sense, and that elements may be differently positioned, or otherwise noted as in the appended claims without requirements of the written description being required thereto.

Figures 7, 8:
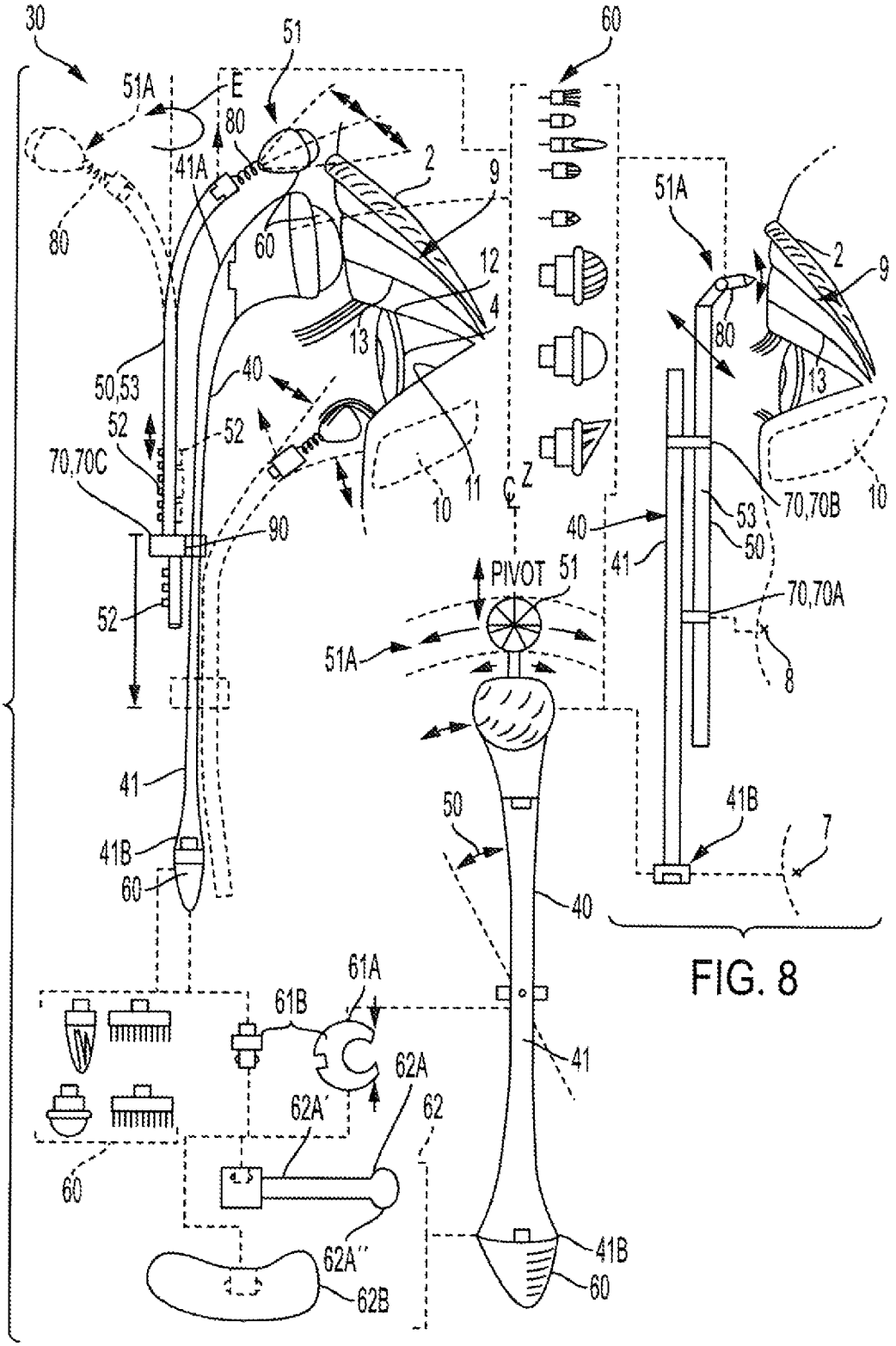

Referring now to FIG. 7 a cosmetic system 30 for use relative to an eye 4 having an eye cover fold 9, a lower eye fold 10, and respective upper eyelid contact surface 12 and lower eyelid contact surfaces 11 relative to a chin boss 7 location and a cheek bone 8 location, as will be discussed.

Cosmetic system 30 includes an adaptive positioning support system 40 shown in a preferred elongate illustration, and an adaptive application member 50 or application member 50 adjustably and removably secured thereto, as will be discussed.

Positioning support system 40 has a shaft portion 41 with an top support end 41A and a bottom support end 41B. Each respective and alternative top and bottom support ends 41A, 41B includes an adaptive system for releasably receiving alternative applicator tip ends 60 on either end thereof.

Additionally, applicator or application member 50 has at least one adaptor end 51. Adaptor end 51 includes an adaptive system for releasably receiving alternative applicator tip ends 60 on the end thereof (or where there are two ends, on either end thereof).

An adaptive connecting system 70 operably connects positioning support system 40 with applicator or application member 50, as shown. In FIG. 7, connecting system 70 is a single member 70C that includes an internal tongue member (not shown) that releasably engages projecting external tongue members 52 whereby a position of applicator 50 is adjustable relative to positioning support system 40. Connecting system 70 may include a mechanical linkage with friction tongues (as shown) or may use any other type of friction resistance, compressive clap, threaded fixture, magnetic arrangement or other means for adjustably or fixably securing positioning support system 40 to applicator 50. For example, as shown in FIG. 8, connection system 70 is provided with a top connecting member 70B and a bottom connecting member 70A, each secured to positioning support system 40 and having a friction opening therein whereby a shaft portion 53 of application member 50 is slidably engaged and repositionable.

As will be further understood from FIG. 7, connecting system 70 allows applicator or application member 50 to rotate and pivot (see 51A and arrows, e.g. E) relative to the shaft portion 41 of positioning support system 40.

As a result, it will be understood that application member 50 may be slid anywhere along the length of positioning support system 40 for user convenience, including rotation relative thereto. Additionally (as noted in the right-hand portion of FIG. 7) connecting system 70 (in a single pivot arrangement 90) may further allow application member 50 as an entire while to pivot (see arrows) relative to the shaft portion 41 arrangement. As a result, one of skill in the art will understand that applicator 50 has at from two to five degrees of movement relative (sliding along, rotating relative, and tilting relative) to a pivot section.

As will be understood by those of skill in the art, applicator tip ends 60 include and adaptive plurality of means for applying a cosmetic composition (blush, toner, paint, or any other form of pigmentation as will be understood by those if skill in the art).

Applicator tip ends may be any form of brush, pad, applicator, felt end, tip, or any other shape or form that may have a narrow, pointed, flat, round, contoured, plush/soft, hard/firm or any other type of tip end to a cosmetic application that may be adjusted within the scope and spirit of the known cosmetic tip ends without limit to the drawings herein.

As will be further understood, applicator tip ends 60 each include an adaptive connecting tip end that is releasably secured to the adaptive end to each end of the applicator end 51, the positioning support system 40, or in other forms suitable to the use of the invention.

As also will be understood, one of the adaptive arrangements herein is the use of a positioning member 61A, 61B that may be removably secured to the positioning support member 40. Positioning member 61A includes a releasably secured construction that may fit into any arrangement also receiving a tip end 60. Positioning member 61B provides a flexible clamp member that may be secured at any position along shaft portion 41 of positioning support system 40. As noted with either positioning member 61A, 61B, they are used for further removably securing positioning aids 62A, 62B. Positioning aid 62A is in the form of a bridge having an elongate shaft portion 62A' and a smooth end 62A" for skin contact proximate cheek bones 8, 8, or any other portion of a user's face (as noted in FIGS. 9, 10, as will be discussed. Positioning aid 61B is in the form of a chin rest shaped to reliably position relative to the position of chin boss 7 on a user's face.

As noted, an applicator end 51 of applicator member 50 include replaceable tip ends 60. Additionally, applicator end 51 includes an angle adjustment system 80 that includes the function of along a contact side of respective tip ends 60 to be adjusted relative to the angle of applicator end 51 in a use-condition by a user's finger. Angle adjustment system 80 may be in any sufficient form to achieve the requirement of angle adjustment but may be in the form of a flexible elastomeric material, a pivot axis a toggle arrangement, a spring, a pivot boss, or any other form of arrangement.

As a result of this arrangement, it will be understood that, in a use example, a user may select a narrow tip end 60 for positioning on end of applicator end 51 (e.g., for drawing in with a cosmetic one or more crease line either laterally (away from the midline) or medially (toward the midline) in whole or part) along the eye cover fold region 9 great accuracy and repeatably on either side of the face.

Additionally, as a result of this arrangement, a user may have preselected a different tip end for securing to a top support end 41A of positioning support system 40 (e.g., a broad applicator brush) so that a user (without repositioning their hand) may use a finger to swing away application member 50, and use tip end 60 to place eye liner or other indicia on the eye cover fold region 9 within increased accuracy and user comfort. It will be understood that the present invention 30 may be used to apply a crease line or eye liner in any order (without limit).

It will be additionally understood by one of skill in the art, that a user may one handedly or two handedly adjust applicator member 50 and thus the applicator end 51 downwardly, along shaft portion 41 so as to position a narrow cosmetic proximate the lower eye lid contact surface 11, the upper eyelid contact surface 12, or in other areas proximate eye 4 without departure from the scope and spirit of the present invention.

Referring now additionally to FIG. 8, a simplified cosmetic applicator is provided in illustrated form pictographically noting that one of the positioning aids 62A, or 62B may be adaptively secured to portions of the positioning support system 40 proximate cheek bone 8 or chin boss 7 allowing adaption and a user's reliably positioning the cosmetic system on a repeatably skeletal structure for day-by-day repetitive and reliable positioning of cosmetics proximate a crease line 13 (or to draw in an artificial crease line 13), eyeliner, blush or for other cosmetic application use.

It will be understood that the scope of the present invention clearly includes a simplified cosmetic system having a positioning support and an application member. It will be further understood that in one alternative aspect of the present invention that the positioning support system and applicator member may be mutually formed or merged into a single adaptive arrangement which includes at least the ability apply a cosmetic to a user's face proximate an eye.

Figure 9:
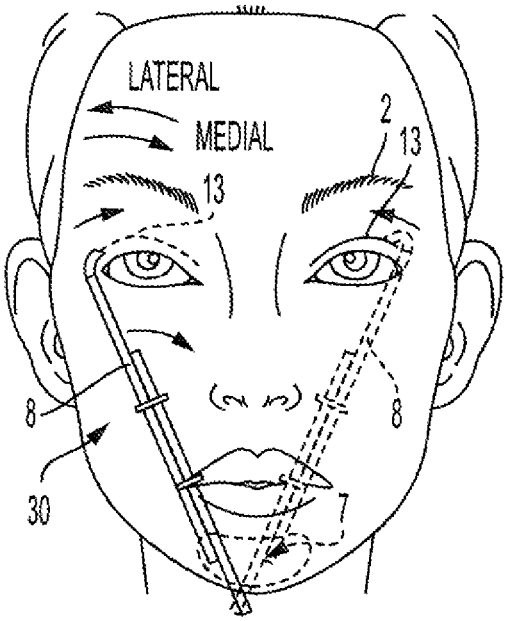
FIG. 9 provides an illustrative view front perspective view of a possible use of one of the alternative adaptive cosmetic systems in a use condition.
Figure 10:
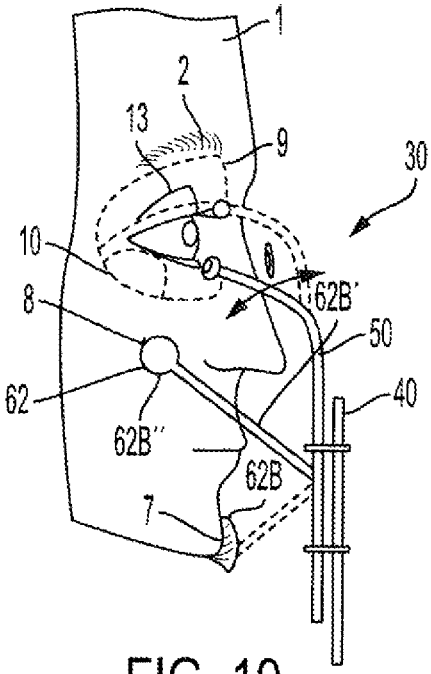
FIG. 10 provides an illustrative side perspective view of a possible alternative use of one of the adaptive cosmetic systems in a use condition.

As will be noted in illustrative FIGS. 9 and 10 a front and side adaptive and pictographic arrangement is provided wherein a cosmetic system 30 may be used with or without positioning aids 62, 62A, 62B relative to facial positions. For example, a user may grasp shaft portion 41 and position their hand on cheek bone location 8, or by eye-corner 4*b*, and repeatably apply the cosmetic to the skin uniformly left-side to right-side.

As will be further understood, tip ends 60 may include smoothing or mixing brushes, pads, or foam allowing a user to apply a cosmetic (first step), and conveniently blend a cosmetic (second step) without departing from the scope and spirit of the present invention.

Figure 11:
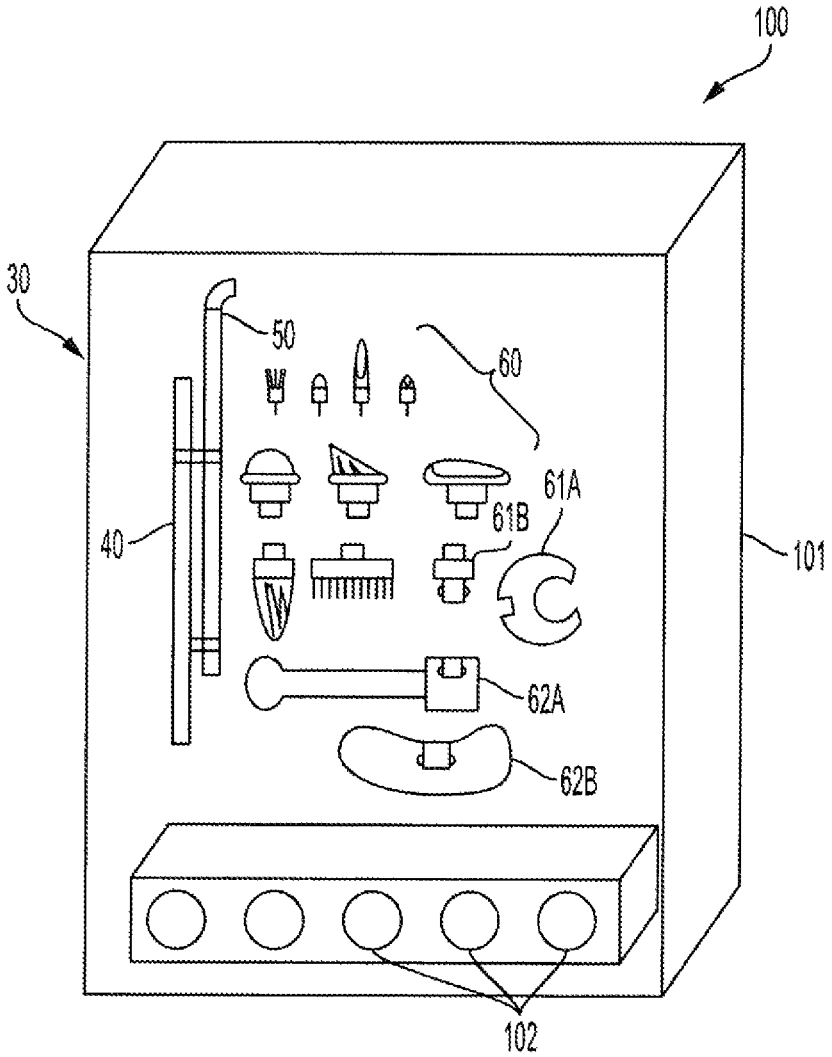
FIG. 11 is an illustrative exemplary view of a kit assembly of a cosmetic system according to an exemplary embodiment of the present invention.

Additionally referring now to FIG. 11, a kit 100 is provided with an exemplary outer container 101 that may contain optionally portions of cosmetic system 30. Additionally as shown, kit 100 may be provided with additional cosmetics 102 (blush, hue, etc.) in any suitable form, in individual containers or in a joint-formation or in any other convenient form, so that kit 100 may be provided to the consuming public in a combined form. It will be further understood by those of skill in the art that kits 100 may be adaptively arranged to contain more or less of the features and articles disclosed in the present invention so as to provide kits having different components and different values all within the scope and spirit of the present invention.

Figure 12:
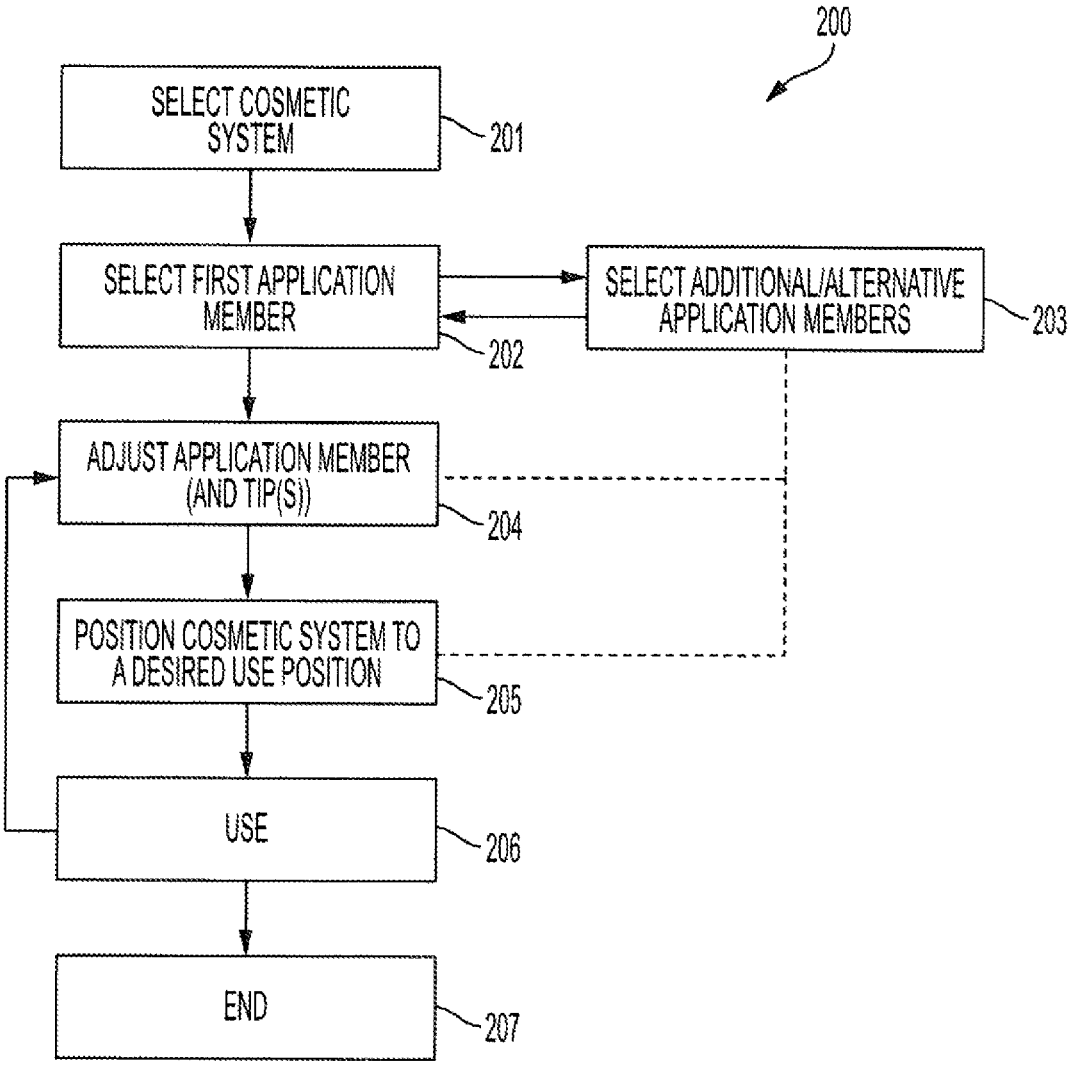
FIG. 12 is an exemplary use flow chart of an exemplary embodiment of the present invention for a user and adjustment.

Additionally referring now to FIG. 12, an optional and adaptive method 200 for using cosmetic system 30 is discussed in a first step 201 where a user selects a desired cosmetic system arrangement and in a step 202 selects desired tip ends 60, 61A, 61B, 62 for receiving securing on positioning support system 40 or application member 50 as discussed herein. In a related step 203 alternative selections may be made. Next in a step 204 a user adjusts the application member and tip ends to a decided-first-cosmetic use on an eye location (e.g., eye liner, blush, crease-application etc.), and in a next step 205 positions the cosmetic system 30 for a desired use position relative to the facial locations discussed earlier. In a next step 206 a user applies the cosmetic (e.g., applies an eye cosmetic, then repositions and using a different tip end forms a crease line 13 in a lateral (or medial) manner). As may be desired by a user, further adjustment may be performed for the same side (left or right) and then a user may use the cosmetic system on the remaining user-side until reaching an end step 207. Thereafter, cosmetic system 30 may be returned to a container 101 in a kit 100 for convenient storage and later use.

Referring now additionally to FIGS. 13-17, where an alternative adaptive cosmetic system 130 is provided with a positioning support 140 supporting an applicator member 150 having an applicator end 151 (in the form shown of a small diamond-shaped brush), relative to a first tip end 160A (shown in an almond brush) on a first end of positioning support 140 and a second tip end 160B (shown as a blender brush) on the opposing side thereof.

Figure 13:
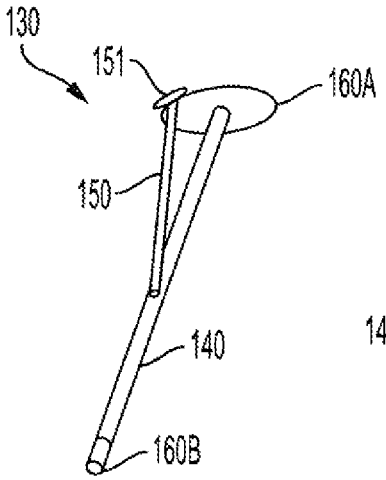
FIG. 13 is an exemplary top view of an alternative cosmetic applicator system.
Figure 14:
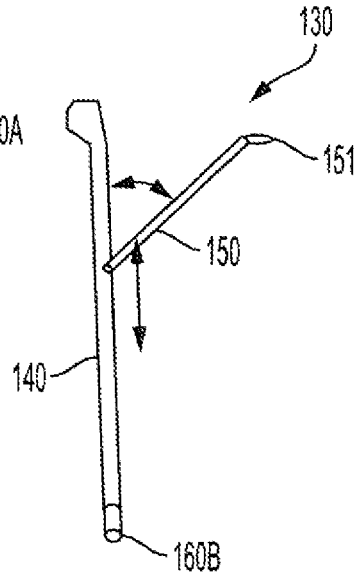
FIG. 14 is a further view of the applicator in FIG. 13 with a member pivoted.

As shown in FIG. 13, it will be understood that applicator member 150 pivots relative to positioning support 140 along a length thereof (at a coupling of applicator member 150 to positioning support 140—the coupling being pivotable so as to also form a fulcrum of the pivoting of applicator member 150) and additionally may slide relatively along the length of support 140 so as to position applicator end 151 in variable positions relative to tip end 160A. Additionally, in one alternative embodiment, a portion of positioning support 140 may telescope in length (e.g., extend along its own length (FIG. 15)). Additionally, applicator end 151 is pivotable relative to the securing location along applicator member 150 so that (FIG. 15) applicator tip end 151 can pivot and swivel relative the support shaft of applicator 150, as illustrated in FIG. 14. Finally, it will be understood that blender brush tip end 160B, applicator end 151 and tip end 160A will be understood to optionally include the replacement tip end systems of any kind, shape, or sort as discussed herein without limitation, for example the use of a brush, a foam pad, and differently shaped foam members and differently shaped brushes.

Figure 16:
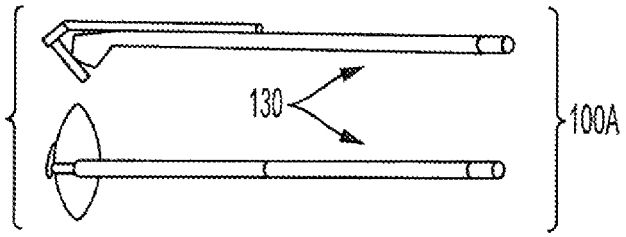
FIG. 16 is a kit form of the cosmetic system in FIG. 13 shown in a packed flat arrangement from a side view and a top view.

Additionally, as seen in FIG. 16, cosmetic system 130 may be compactly stored in the form of a kit arrangement 100A using a container.

Figure 17:
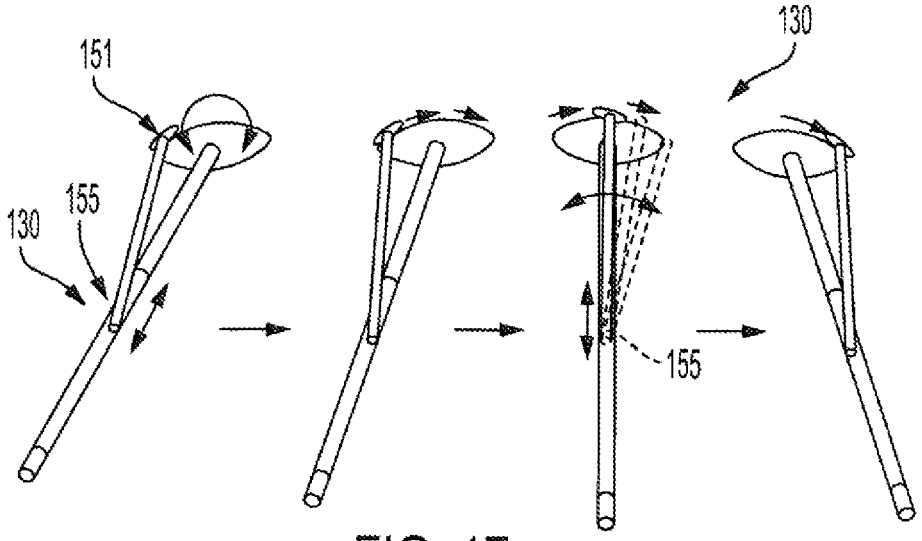
FIG. 17 is the alternative cosmetic applicator system of FIG. 13 shown in an adaptive alignment and pivoting sequence as if in an adaptive use procedure, noting that applicator ends and tip ends pivot and rotate relative to their respective supports and relative to each other.

FIG. 17 includes diagrams showing a pivoting motion of cosmetic system 130 in a left-to-right flow process where tip ends may be pivoted, shifted, and curved through arcs-of-use relative to pivot positions, as will be described in further detail below with reference to FIGS. 18-23.

Figure 5:
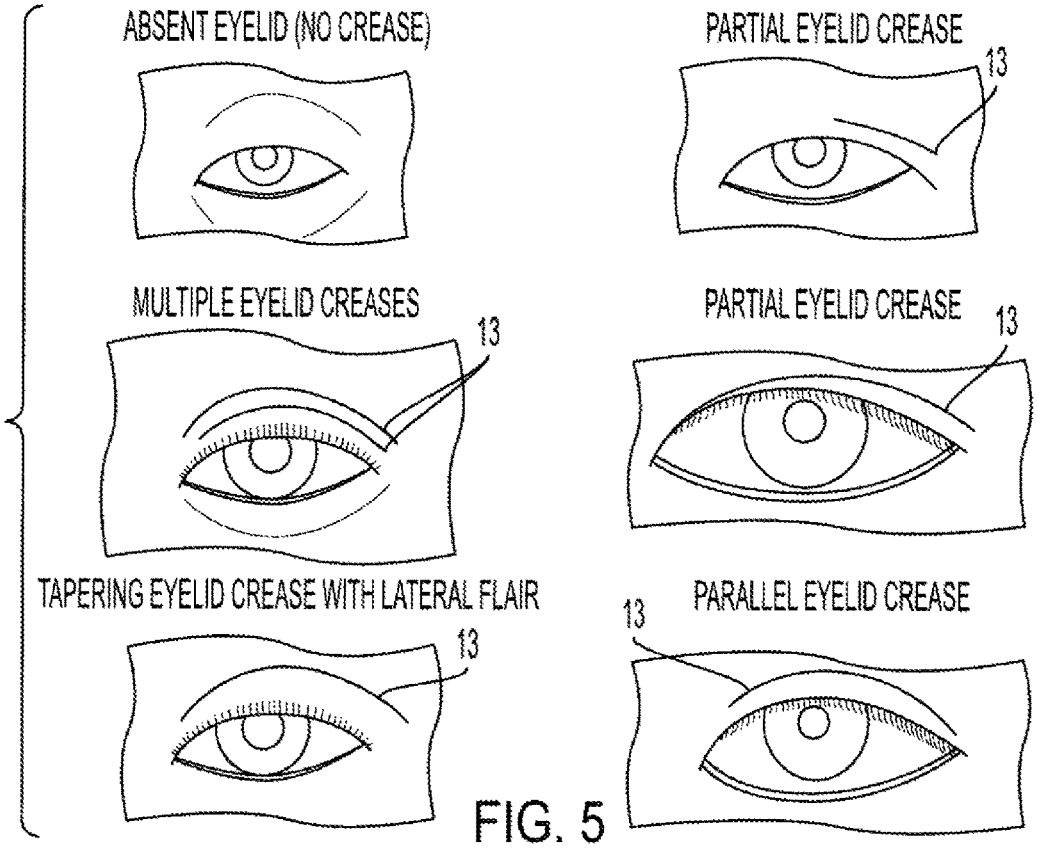
FIG. 5 is a graphical illustration of alternative eye-lid creases noting a wide variety in the art. As noted, user's eye lid-upper eye cover folds 9 may be shaped with no crease 13, with tapering creases, lateral flairs, parallel creases, or even multiple creases 13.
Figure 6:
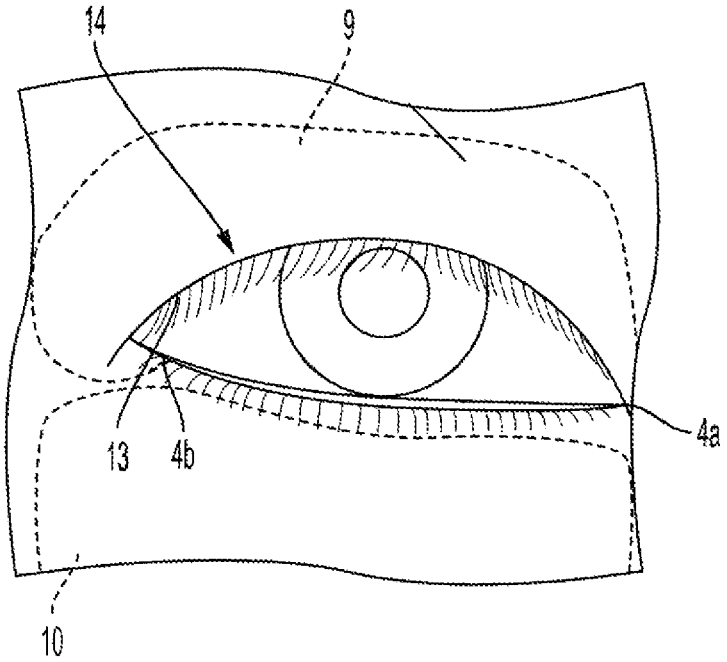
FIG. 6 is a graphical illustration of a further eye-lid construction including an extending skin fold (epicanthic fold) which provides a hidden or rolled-over crease FIGS. 7 and 8 provide an illustrative cosmetic system comprising a number of alternative members and adaptive features according to an exemplary embodiment of the invention.

As shown in FIG. 17, cosmetic apparatus (system) 130 may be used to apply cosmetics by pivoting applicator end 151 along an arced path, which may be along an edge of tip end 160A (for example, an almond brush). According to an exemplary embodiment of the invention, applicator member 150 having applicator end 151 may be attached to cosmetic apparatus 130 by a pivotable coupling 155 so that applicator end 151 can be pivoted from one side along a top edge of tip end 160A to the other side, as shown in FIG. 17, and vice versa, whereby pivotable coupling 155 also forms a fulcrum for the pivoting of applicator member 150. Accordingly, cosmetics may be applied accurately and repeatedly by tracing along the arced path defined by the edge of tip end 160A, for example, for drawing in cosmetics to correspond with or to simulate a natural eyelid crease 13. In accordance with an exemplary embodiment of the invention, tip end 160A may be replaceable so that elements having different shapes, sizes, etc., (for example, an almond brush of a different size or a differently shaped brush) may be used to trace different cosmetic applications. As an example, almond brushes of different sizes and shapes may be provided to accommodate users having different eye sizes and shapes, as illustrated in FIG. 5. Correspondingly, as shown in FIG. 17, the pivotable coupling 155 for applicator end 151 may be slidable along a length of positioning support 140 to accommodate different uses.

Figure 18:
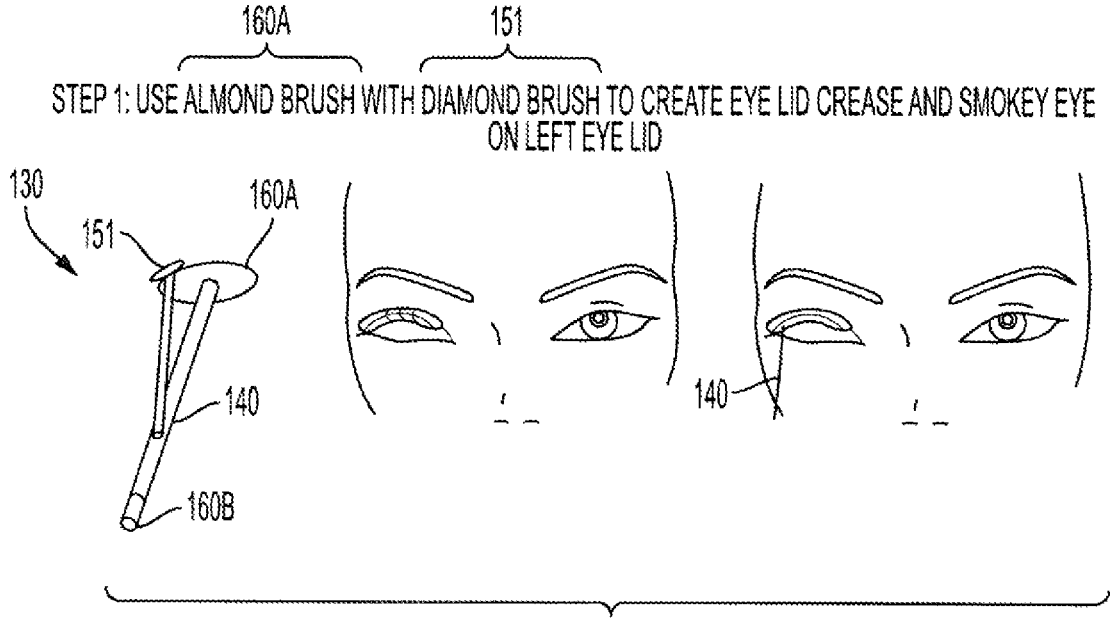
FIGS. 18-23 are a series of use images for an adaptive cosmetic apparatus according to an exemplary embodiment of the invention.

FIG. 18 illustrates cosmetics to an eyelid region 9 applied to create/supplement a crease line 13 by the pivoting motion shown in FIG. 17 for applicator end 151 in accordance with an exemplary embodiment of the invention. As shown in FIG. 18, tip end 160A—for example, an almond brush—may be placed over the eyelid of the user to serve as a stationary anchor for applicator 130. Accordingly, the pivoting motion of applicator end 151 along an edge of tip end 160A results in cosmetics being applied to a user's eyelid region 9 along a substantially arced path that would correspond to a natural or artificial crease line 13.

Figure 19:
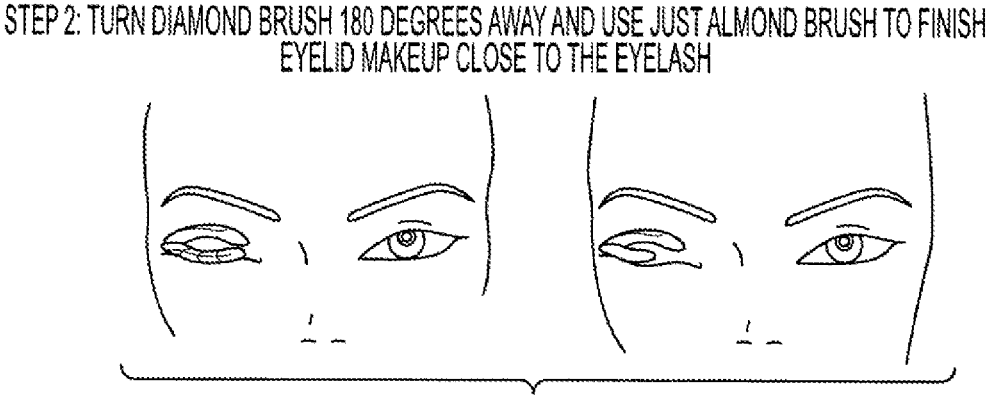

FIG. 19 illustrates cosmetics applied to a user's eyelid region 9 using tip end 160A with applicator member 150 pivoted away from positioning support 140, as shown in FIG. 14, in accordance with an exemplary embodiment of the invention. In particular, tip end 160A may be used to apply cosmetics along a region proximate the eyelashes. FIG. 19 includes two examples of cosmetics being applied to regions of varying proportions and shapes.

Figure 20:
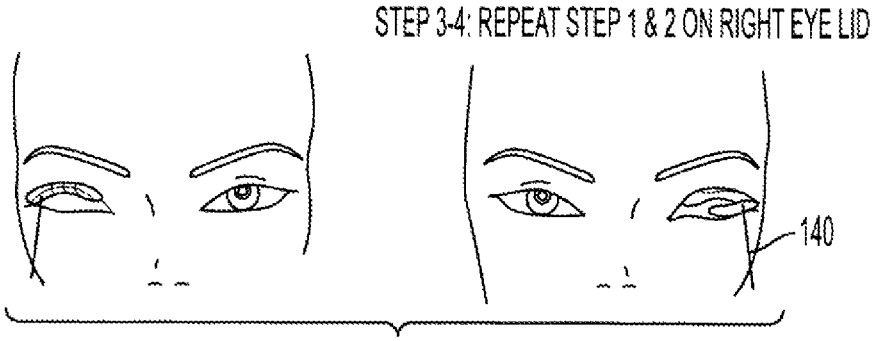

FIG. 20 illustrates a repeat of the pivoting motion cosmetics application shown in FIG. 18 and the tip end 160A cosmetics application shown in FIG. 19 for the user's other eye according to an exemplary embodiment of the invention.

Figure 21:
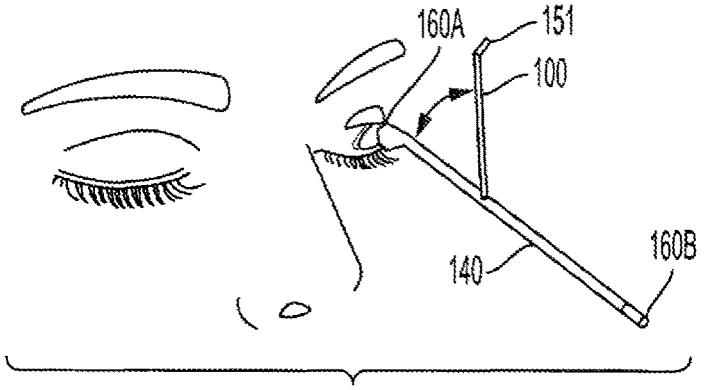

FIG. 21 illustrates the use of tip end 160A for applying the cosmetics shown in FIG. 19 in accordance with an exemplary embodiment of the invention. As shown in FIG. 21, tip end 160A may be used to apply cosmetics along a region proximate the eyelashes with applicator member 150 pivoted away from positioning support 140 so that it (and applicator end 151) does not obstruct the cosmetics application using tip end 160A.

Figure 22:
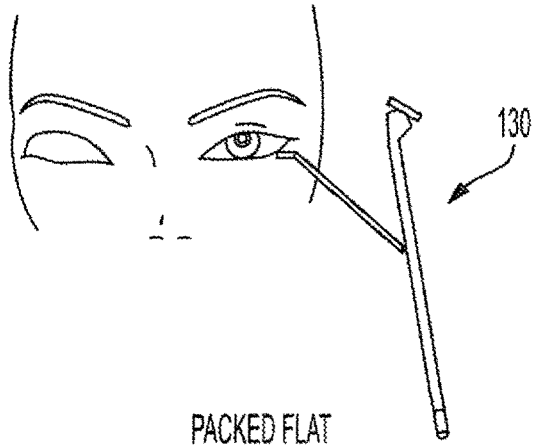

FIG. 22 illustrates applicator end 151 being used to apply cosmetics proximate the eyelashes on a lower eyelid with applicator member 150 pivoted away from positioning support 140 according to an exemplary embodiment of the invention.

Figure 15:
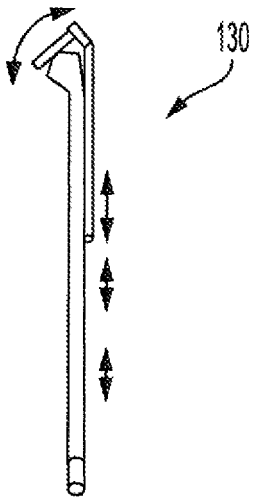
FIG. 15 is a further view of the applicator in FIG. 13 in a pivot arrangement.
Figure 23:
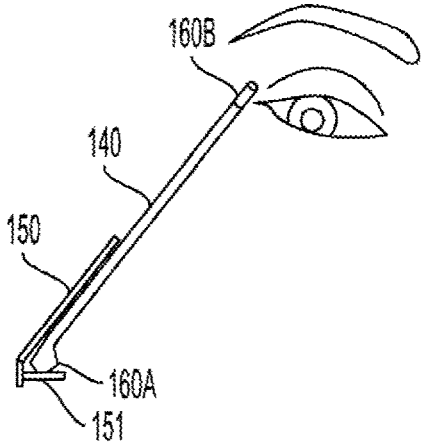

FIG. 23 illustrates second tip end 160B being used as a blender for blending already-applied cosmetics in accordance with an exemplary embodiment of the invention. As shown in FIG. 23, applicator member 150 may be packed close to positioning support 140 in a storage configuration, for example as shown in FIGS. 15 and 16, when second tip end 160B is being used.

Figure 24A:
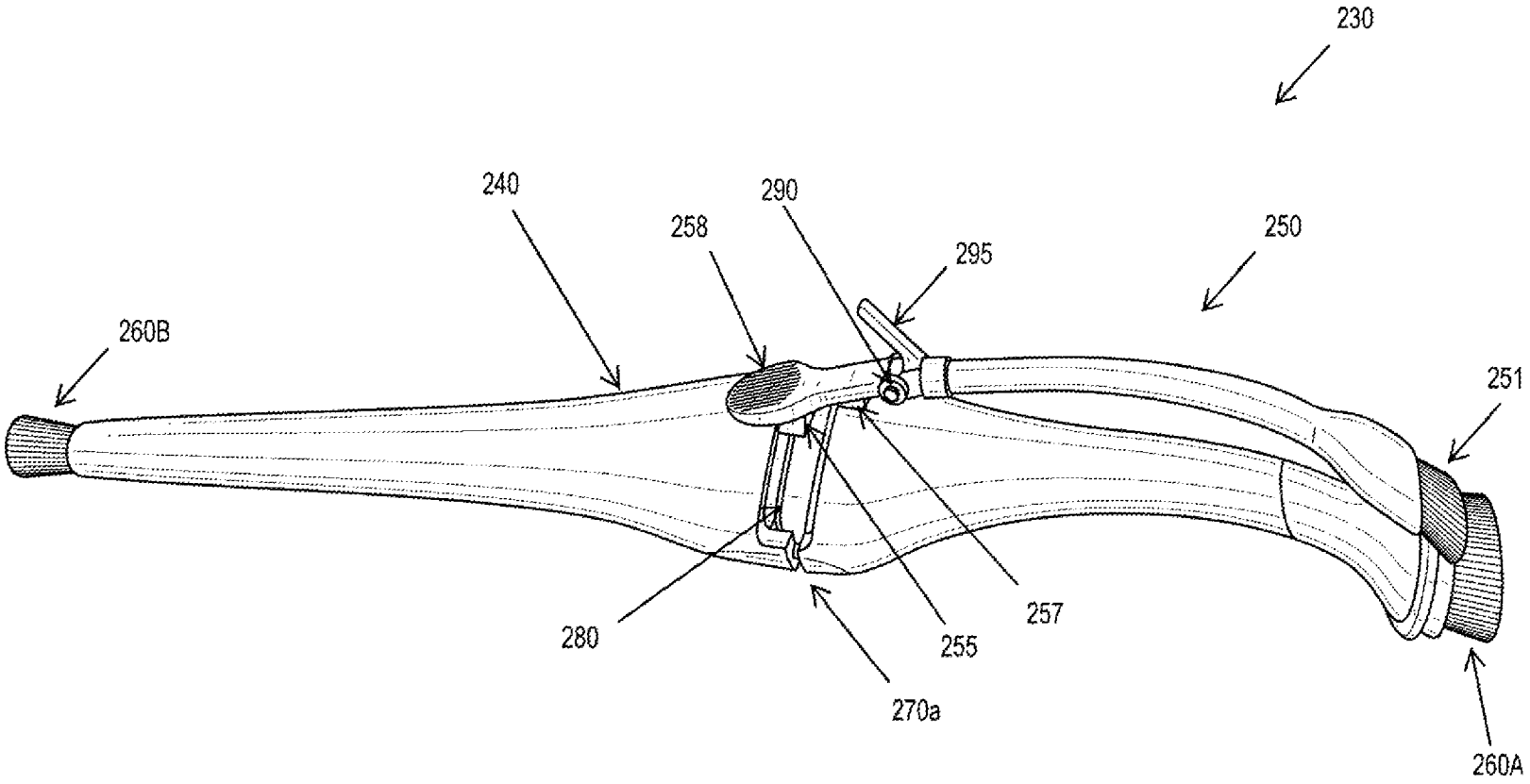
FIGS. 24A-C are perspective, back, and front views, respectively, of a cosmetic applicator with a movable element in accordance with another exemplary embodiment of the invention.
Figure 24B:
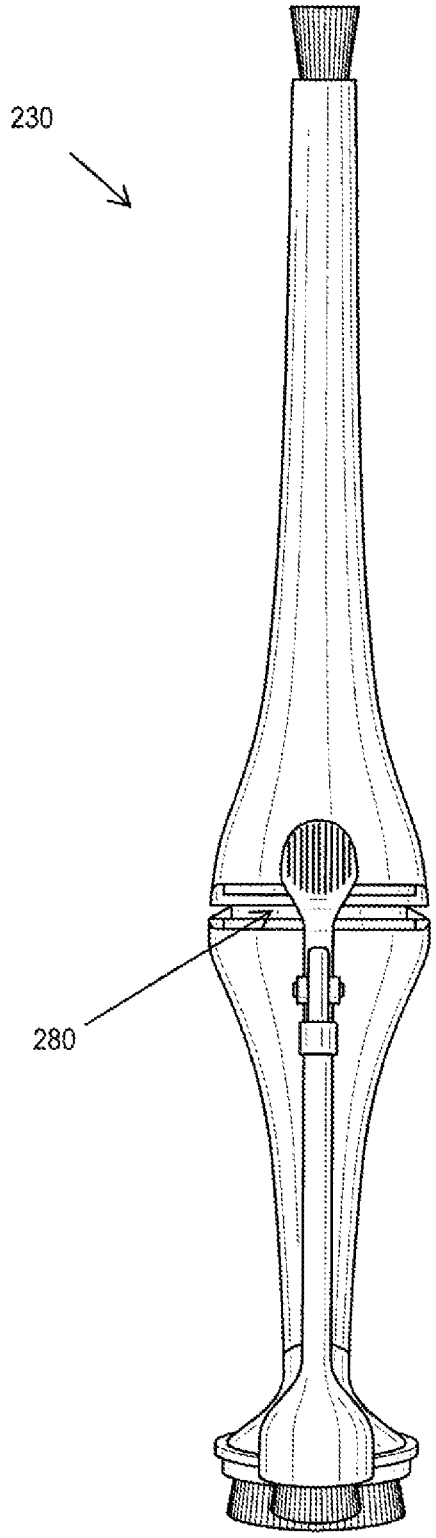
Figure 24C:
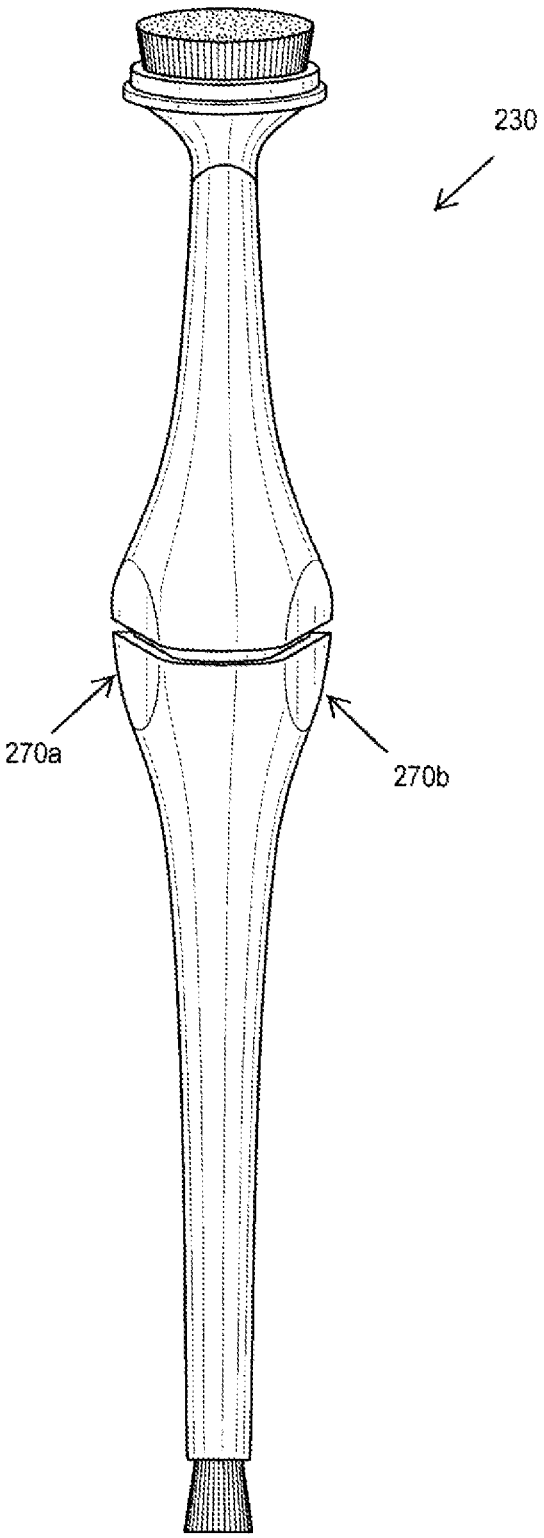

FIGS. 24A-C are perspective, back, and front views, respectively, of a cosmetic applicator 230 shown with a movable element (or "applicator or application member") 250 in accordance with another exemplary embodiment of the invention. As shown in FIGS. 24A-C, cosmetic applicator 230 may comprise an elongate main body 240 for a user to hold in a self-application of cosmetics according to the procedures described above—for example, as illustrated in FIGS. 17-23. As shown in FIGS. 24A and 24C, main body 240 may comprise a pair of relatively flat surfaces 270*a* and 270*b* on respective sides. An elongate opening 280 for accommodating an attachment arm 255 of movable element 250 may be disposed across a back portion of main body 240 proximate the flat surfaces 270*a* and 270*b*, as illustrated in FIGS. 24A and 24B. Attachment arm 255 of movable element 250 may be attached to an internal feature of the main body 240 through elongate opening 280, as will be described in further detail below. As shown in FIGS. 24A and 24B, elongate opening 280 may extend across a back portion of main body 240 in order to provide support and to define a movement range of movable element 250. In particular, movable element 250 may be moved along elongate opening 280 in a side-to-side manner in relation to main body 240 so that applicator head 251 can be moved in an arced side-to-side manner in relation to main applicator 260A for a cosmetic application, for example as illustrated in FIGS. 17 and 18. According to an exemplary embodiment of the invention, movable element 250 may incorporate a support element 257, which may comprise a polymer, woven, felt, fibrous, or any soft material, and the like, formed in a pad, for contacting and sliding along the outer surface on the back portion of main body 240 as movable element 250 is moved side-to-side. Support element 257 may provide a desired amount of friction so that movable element 250 can be moved steadily with constant force during use, which is advantageous for cosmetic applications. Correspondingly, movable element 250 may further incorporate a tab element 258 comprising a patterned surface. Tab element 258 provides a user's finger or thumb a relatively enlarged surface for controlling and moving movable element 250 during use. For example, as described above, a user may use applicator head 251 for drawing in, with a cosmetic, one or more crease lines either laterally (away from the midline) or medially (toward the midline) in whole or part along the eye cover fold region 9 repeatably and with accuracy on either side of the face. For this crease line application, movable element 250 may be moved side-to-side with a finger on tab element 258 so that applicator head 251 may be used for the application without needing to rotate the main body 240 of cosmetic applicator 230. Consequently, the crease line application may be performed with improved stability and accuracy.

Corresponding to the description above, cosmetic applicator 230 having main body 240 comprises applicator head 251, which may be a small diamond-shaped, oval, flat, or pointed brush, sponge, and the like. Main body (or "positioning support") 240 comprises a first tip end main applicator 260A on a first end and a second tip end secondary applicator 260B on the opposing side thereof. According to an exemplary embodiment of the invention, first tip end main applicator 260A may incorporate a brush, a sponge, and the like, for applying cosmetics.

Figure 25:
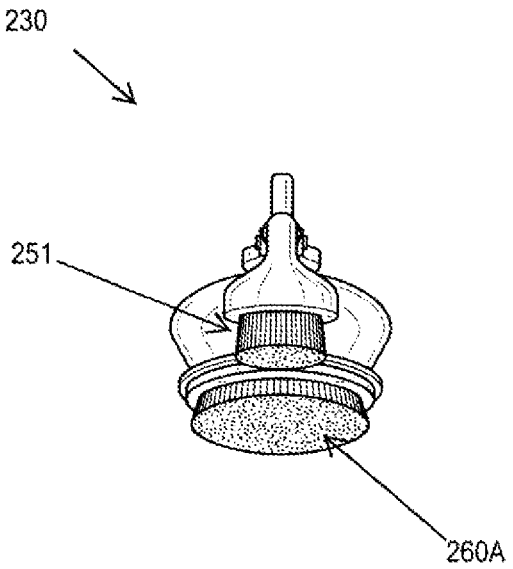
FIG. 25 is a top view of the cosmetic applicator of FIGS. 24A-C showing exemplary embodiments of a main applicator and an applicator head thereof.

FIG. 25 is a top view of cosmetic applicator 230 showing exemplary embodiments of main applicator 260A and applicator head 251. As shown in FIG. 25, applicators 251 and 260A may be brushes, sponges, and the like, having approximately corresponding oval shapes with main applicator 260A having a larger coverage for applying cosmetics, say, in region 9 (for example as shown in FIG. 21), while applicator head 251 may have a smaller and more precise arrangement for, say, drawing in one or more crease lines in region 9 (for example, as shown in FIGS. 18-20). As can be appreciated by one of ordinary skill in the art, the size, shape, material, arrangement, orientation, etc., of applicators 251 and 260A may be adjusted and changed without departing from the scope and spirit of the invention.

Figure 26:
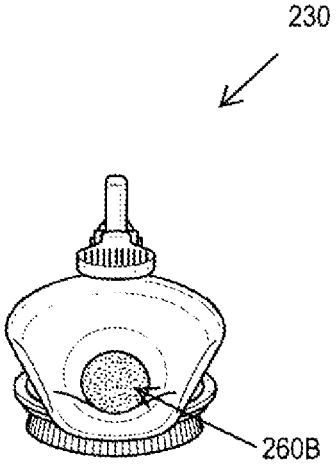
FIG. 26 is a bottom view of the cosmetic applicator of FIGS. 24A-C showing an exemplary embodiment of a secondary applicator thereof.

FIG. 26 is a bottom view of cosmetic applicator 230 showing an exemplary embodiment of secondary applicator 260B, which may be a blender brush and the like in correspondence with the description above. As shown in FIG. 26, applicator 260B may be a circular brush, sponge, and the like, for blending cosmetics that have already been applied onto a user's face.

Figure 27A:
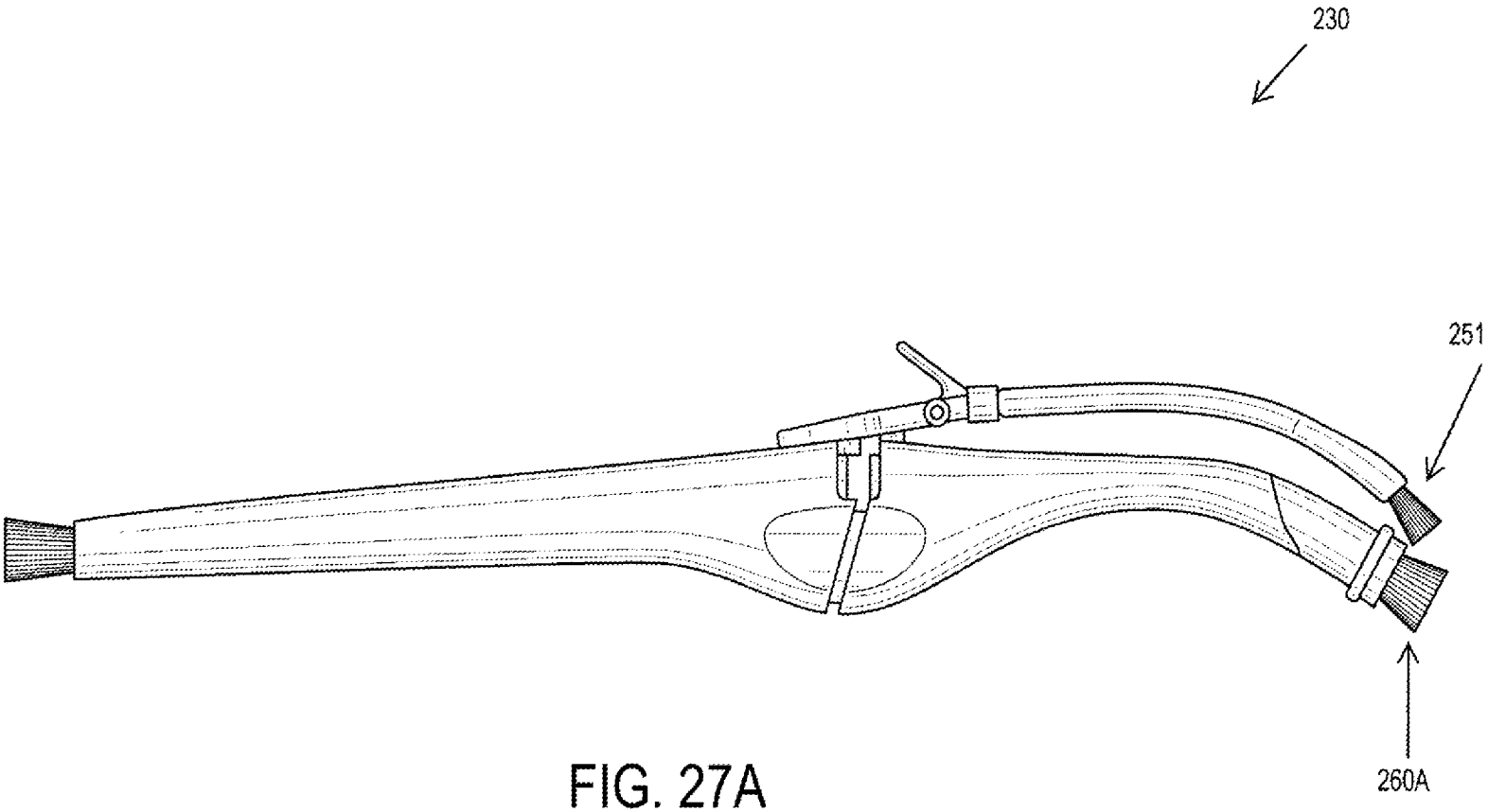
FIG. 27A is a side view of the cosmetic applicator of FIGS. 24A-C illustrating a relationship between applicators thereof and FIGS. 27B-E are perspective and side views of the cosmetic applicator of FIGS. 24A-C with its movable element pivoted away from its main body in respective alternative orientations.

In accordance with an exemplary embodiment of the invention, movable element 250, in addition to the side-to-side swivel movement during use, may further incorporate a hinge element 290 and corresponding shaft 295 for pivoting movable element 250 away from main body 240. FIG. 27A is a side view of cosmetic applicator 230 illustrating a relationship between applicators thereof and FIGS. 27B-E are perspective and side views of the cosmetic applicator 230 shown in FIGS. 24A-26 with movable element 250 pivoted away from main body 240 in respective alternative orientations.

As shown in FIG. 27A, in a first position of movable element 250 for cosmetic application—for example, the side-to-side cosmetic application described above and illustrated in FIGS. 17 and 18—applicator head 251 may be aligned with applicator 260A so that a plane approximating a cosmetic application surface of applicator head 251 (or an orthogonal axis extending therefrom) may form an angle between about −30 degrees and +30 degrees with a plane approximating a cosmetic application surface of applicator 260A (or an orthogonal axis extending therefrom). Preferably, a plane approximating a cosmetic application surface of applicator head 251 (or an orthogonal axis extending therefrom) may form an angle between about −10 degrees and +10 degrees with a plane approximating a cosmetic application surface of applicator 260A (or an orthogonal axis extending therefrom)—or more preferably, the planes/axes may be substantially parallel with one another for applying cosmetics to simulate and/or supplement a crease line, as shown in FIGS. 17 and 18.

Figure 27B:
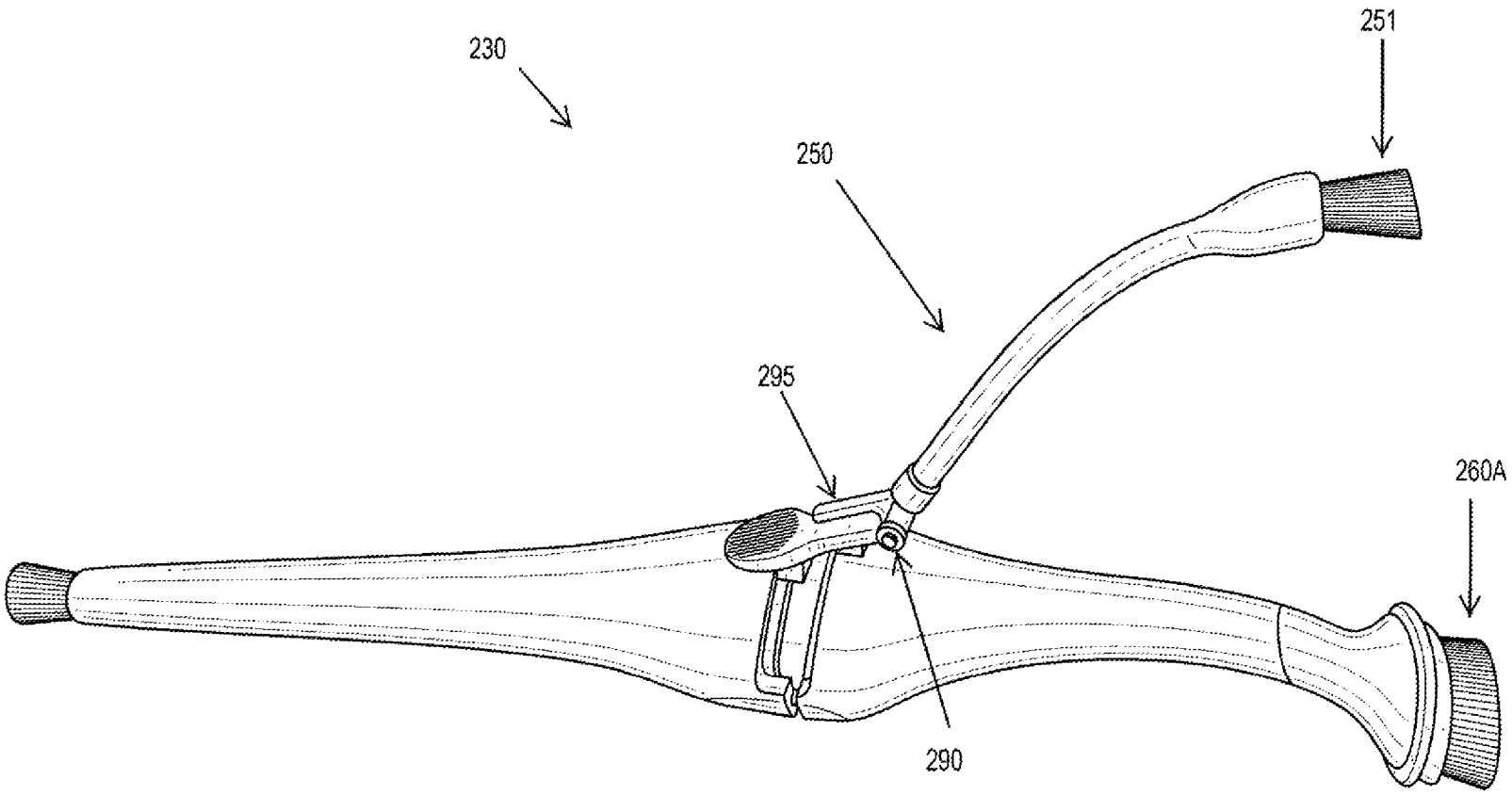
Figure 27C:
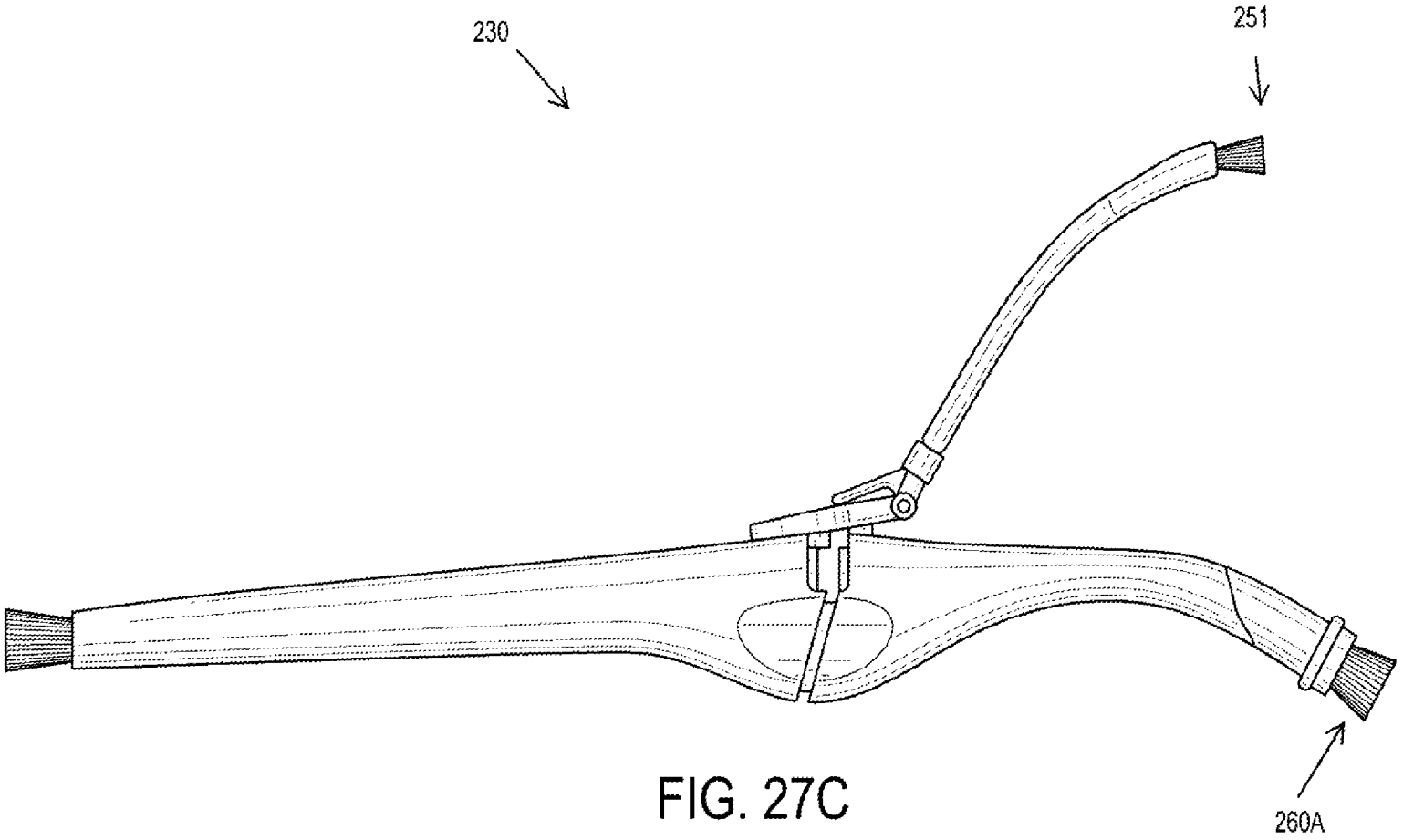

As shown in FIGS. 27B and 27C, a user may push down on shaft 295 so as to pivot movable element 250 around hinge element 290 and away from main body 240. In this orientation, a user may apply cosmetics using main applicator 260A without any obstruction from applicator head 251, for example, as illustrated in FIG. 21, for applying cosmetics to an upper eyelid. As illustrated in FIG. 27C, a plane approximating a cosmetic application surface of applicator head 251 (or an orthogonal axis extending therefrom) may form an angle between about 20 and 90 degrees with a plane approximating a cosmetic application surface of applicator 260A (or an orthogonal axis extending therefrom).

Figure 27D:
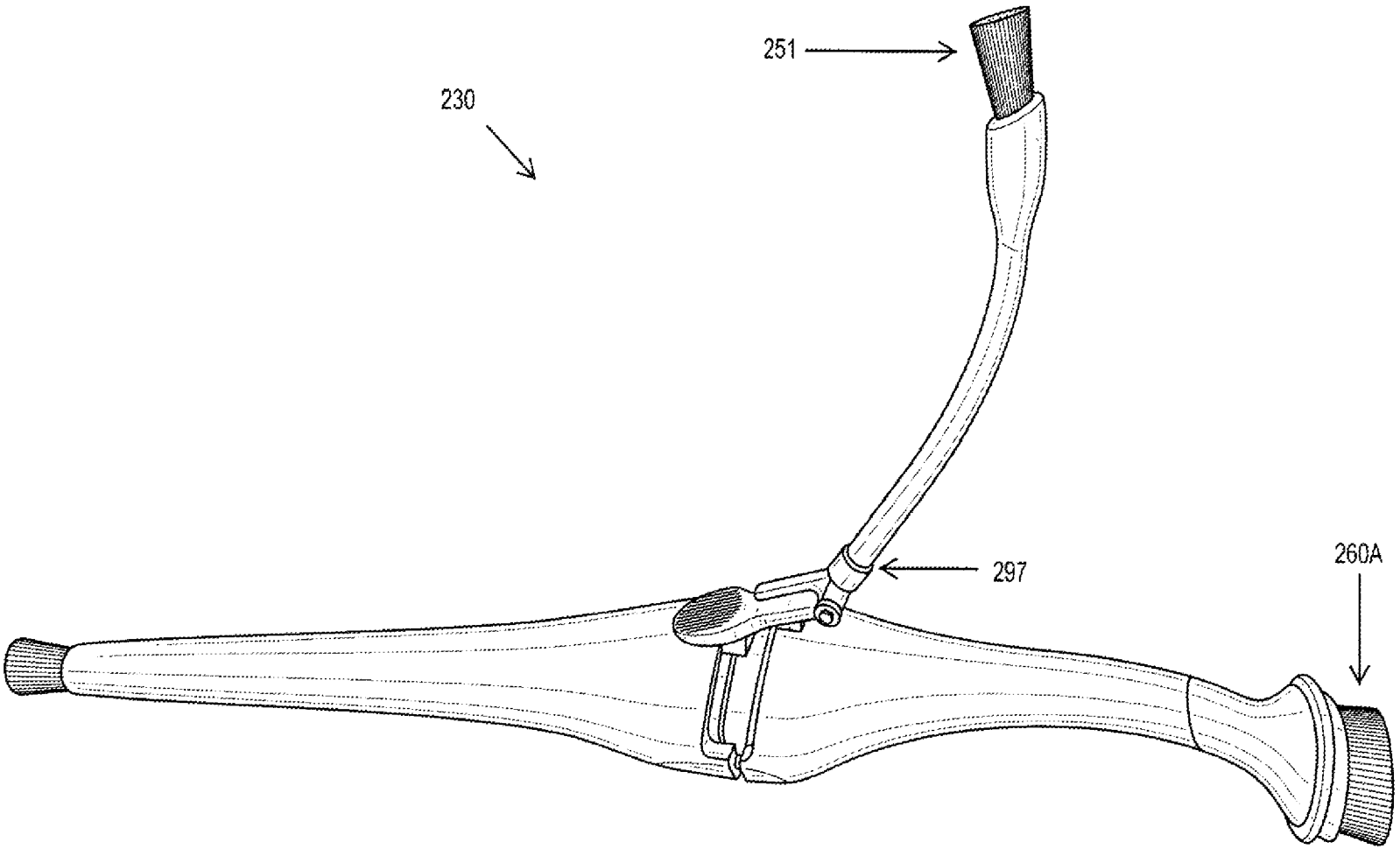
Figure 27E:
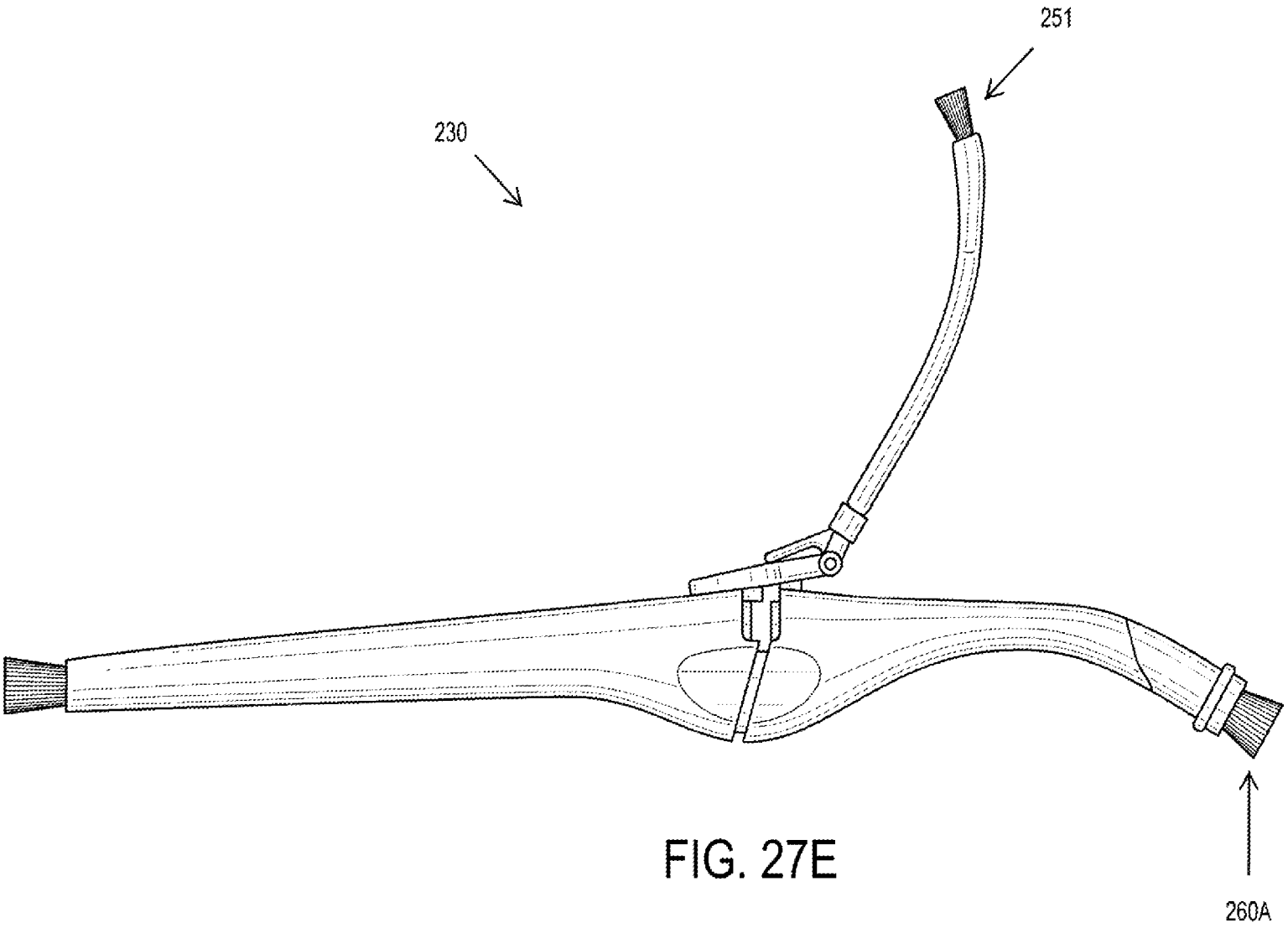

As shown in FIGS. 27D and 27E, movable element 250 may further comprise a detachable coupling 297 that is also rotatable for orienting applicator head 251 away from main applicator 260A. In this orientation, a user may apply cosmetics using applicator head 251 without any obstruction from main applicator 260A—for example, as illustrated in FIG. 22, for applying cosmetics to a lower eyelid. As illustrated in FIG. 27E, a plane approximating a cosmetic application surface of applicator head 251 (or an orthogonal axis extending therefrom) may form an angle above 90 degrees, preferably between about 90 degrees and about 180 degrees, with a plane approximating a cosmetic application surface of applicator 260A (or an orthogonal axis extending therefrom).

According to an exemplary embodiment of the invention and as will be described in further detail below, coupling 297 may provide for completely detaching applicator head 251 from cosmetic applicator 230. Therefore, as an option, a user may apply cosmetics using applicator head 251 without it being attached to cosmetic applicator 230.

Mechanical features of movable element 250 according to an exemplary embodiment of the invention will now be described in further detail with reference to FIGS. 28-33B.

Figure 28:
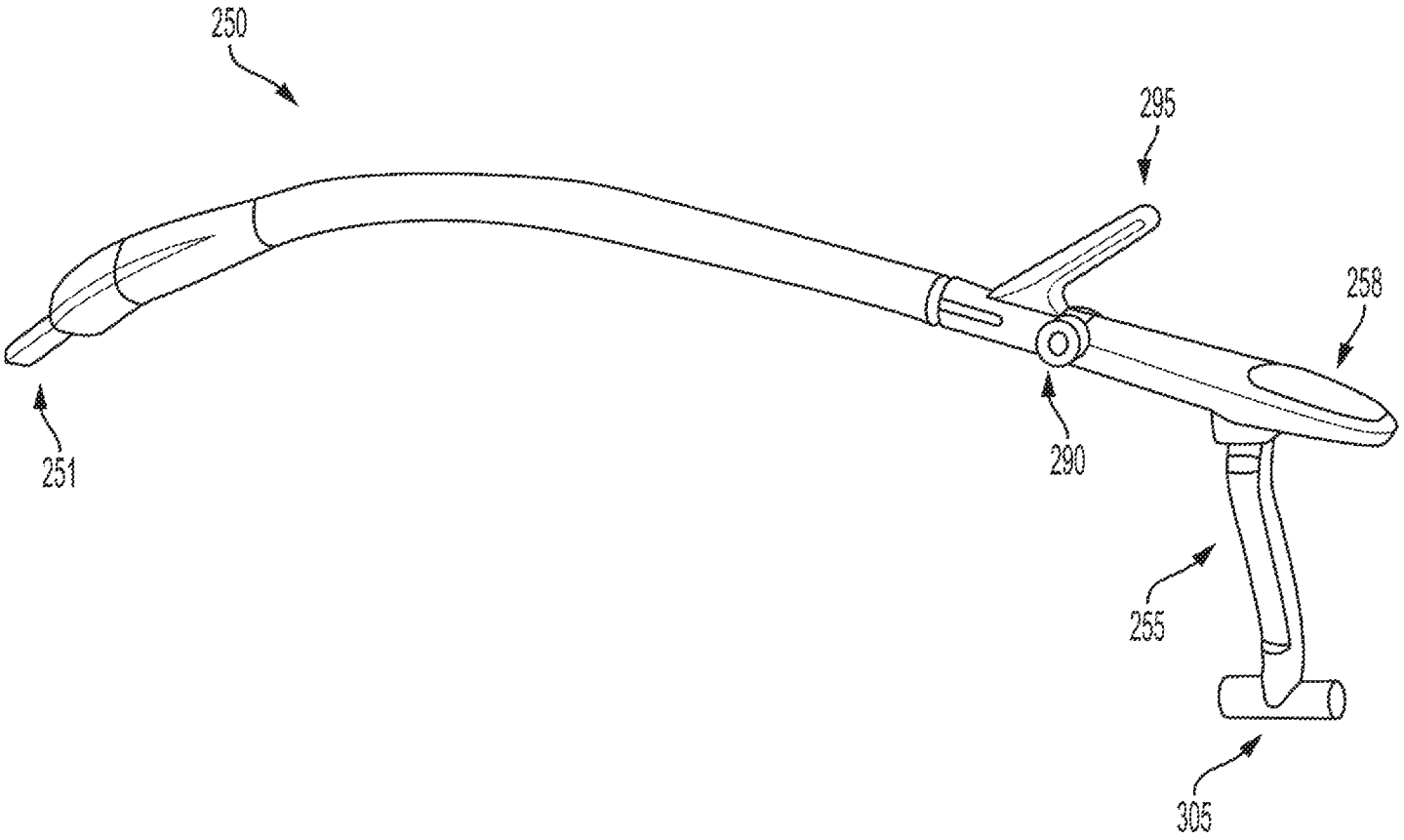
FIG. 28 is a perspective view illustrating a movable element according to an exemplary embodiment of the invention.

FIG. 28 is a perspective view illustrating movable element 250 according to an exemplary embodiment of the invention. In particular, FIG. 28 shows movable element 250 without being integrated with cosmetic applicator 230. As shown in FIG. 28, attachment arm 255 of movable element 250 may comprise a substantially cylindrical (fulcrum) element 305 on an end for engaging a corresponding element on the internal structure of main body 240 to provide movable element 250 with an anchor and a fulcrum for pivoting movable element 250 for its side-to-side movement—and thereby forming a pivotable coupling for movable element 250 to main body 240 of cosmetic applicator 230. According to an exemplary embodiment of the invention, tab element 258 is in substantial alignment with fulcrum element 305 so that movement force applied by the user on tab element 258 can steadily pivot movable element 250. One of ordinary skill in the art can appreciate that other shapes, orientations, and arrangements of elements may be used in place of element 305 for providing movable element 250 with a steady pivot motion without departing from the scope of the invention.

Figure 29A:
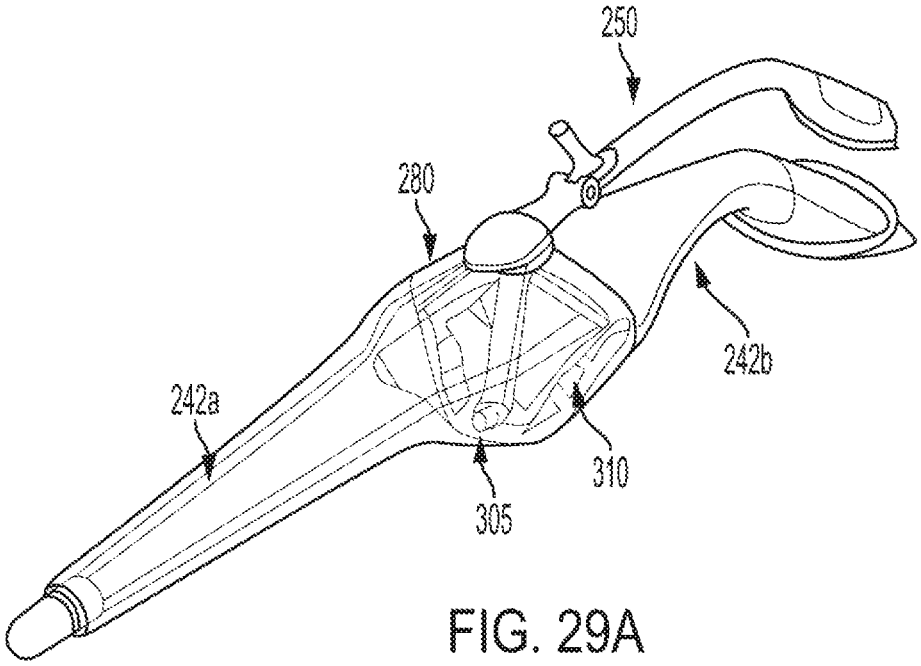
FIGS. 29A-C are bottom perspective, top perspective, and cross-sectional views, respectively, of the cosmetic applicator of FIGS. 24A-C showing the internal engagement between the movable element and the cosmetic applicator according to an exemplary embodiment of the invention.
Figure 29B:
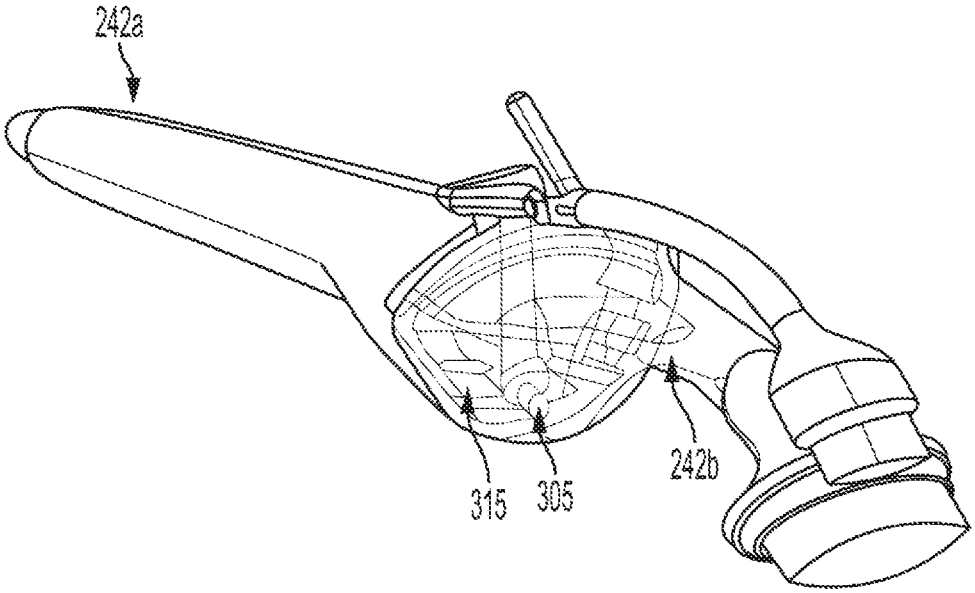

FIGS. 29A and 29B are bottom perspective and top perspective views, respectively, of cosmetic applicator 230 showing the internal engagement between movable element 250 and cosmetic applicator 230 according to an exemplary embodiment of the invention. As shown in FIGS. 29A and 29B, main body 240 of cosmetic applicator 230 may comprise two sections 242*a* and 242*b* that may be disassembled from each other. According to an exemplary embodiment of the invention, the respective lengths of sections 242*a* and 242*b* may have from a 1-to-1 proportional relationship to about a 3-to-1 relationship—or preferably about 2-to-1 in relative lengths.

FIG. 29A is a bottom perspective view of cosmetic applicator 230 with bottom portion 242*a* of main body 240 shown in transparency to illustrate attachment arm 255 and cylindrical element 305 of movable element 250. Corresponding to the description above, attachment arm 255 of movable element 250 may extend through elongate opening 280 in main body 240 with cylindrical element 305 anchored near an opposite side within main body 240. As shown in FIG. 29A, section 242*b* of main body 240 may comprise one or more openings 310 for receiving corresponding protrusion(s) 315 (shown in FIG. 29B) on section 242*a* for engagement in assembling main body 240. In addition, section 242*b* may comprise a substantially circular opening 320*a* (shown in FIG. 29C) having a similar circumference as cylindrical element 305 for a rotatable engagement with cylindrical element 305. According to an exemplary embodiment of the invention, a coating, sleeve, covering, ring, and the like, made from a lubricating and/or resilient material, such as a polymeric material, etc., may be placed between cylindrical element 305 and circular opening 315 for reducing friction, wear and tear, etc. in providing for the rotatable anchor of movable element 250.

FIG. 29B is a top perspective view of cosmetic applicator 230 with top portion 242*b* of main body 240 shown in transparency to illustrate attachment arm 255 and cylindrical element 305 of movable element 250. Corresponding to the description above, attachment arm 255 of movable element 250 may extend through elongate opening 280 in main body 240 with cylindrical element 305 anchored near an opposite side within main body 240. As shown in FIG. 29B, section 242*a* of main body 240 may comprise one or more protrusions 315 for inserting into corresponding opening(s) 310 (shown in FIG. 29A) in section 242*b* for engagement in assembling main body 240. In addition, section 242*a* may comprise a substantially circular opening 320*b* (shown in FIG. 29C) having a similar circumference as cylindrical element 305 for a rotatable engagement with cylindrical element 305. According to an exemplary embodiment of the invention, a coating, sleeve, covering, ring, and the like, made from a lubricating and/or resilient material, such as a polymeric material, etc., may be placed between cylindrical element 305 and circular opening 315*b* for reducing friction, wear and tear, etc. in providing for the rotatable anchor of movable element 250.

Figure 29C:
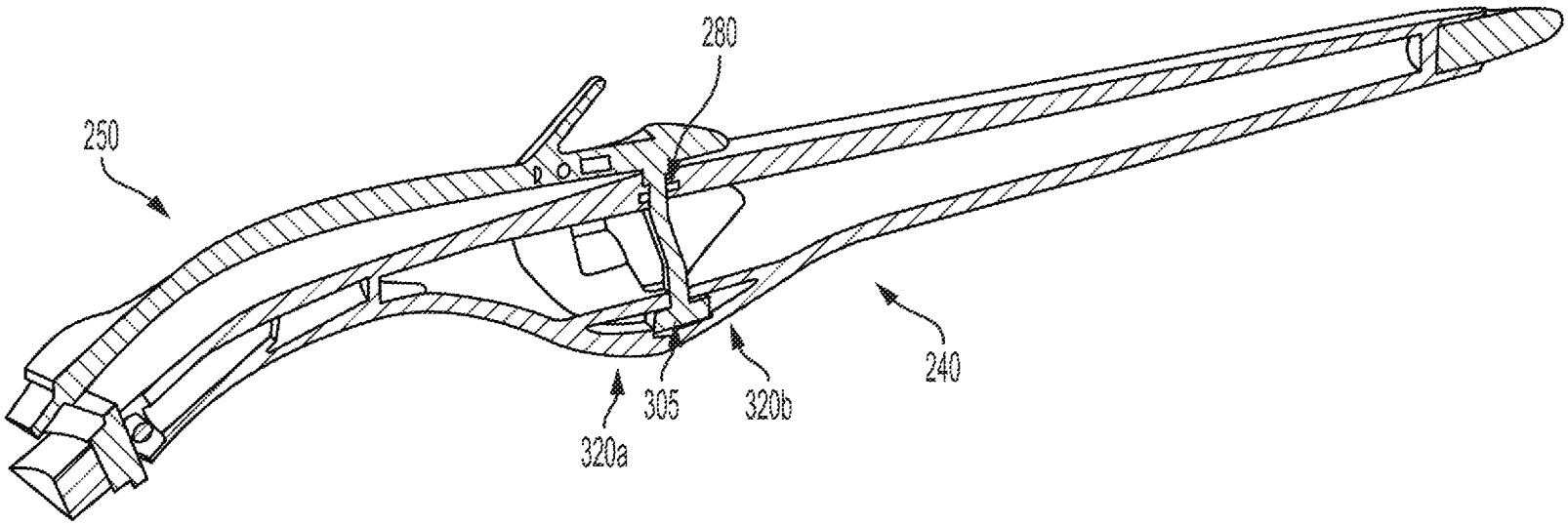

FIG. 29C is a cross sectional view of cosmetic applicator 230 illustrating the internal engagement of movable element 250 to main body 240. As shown in FIG. 29C, openings 315*a* and 315*b* of sections 242*b* and 242*a*, collectively, may provide a two-sided engagement with cylindrical element 305 when main body 240 is assembled to thereby provide a secure, rotatable anchor and fulcrum for movable element 250. The respective circumferences of openings 315*a* and 315*b*—and correspondingly, the two sides of cylindrical element 305—may be substantially the same or may be different. According to an exemplary embodiment of the invention, a top portion of cylindrical element 305—and correspondingly, opening 315*a*—may have a larger circumference than a bottom portion of cylindrical element 305—and correspondingly, opening 315*b*.

Figure 30A:
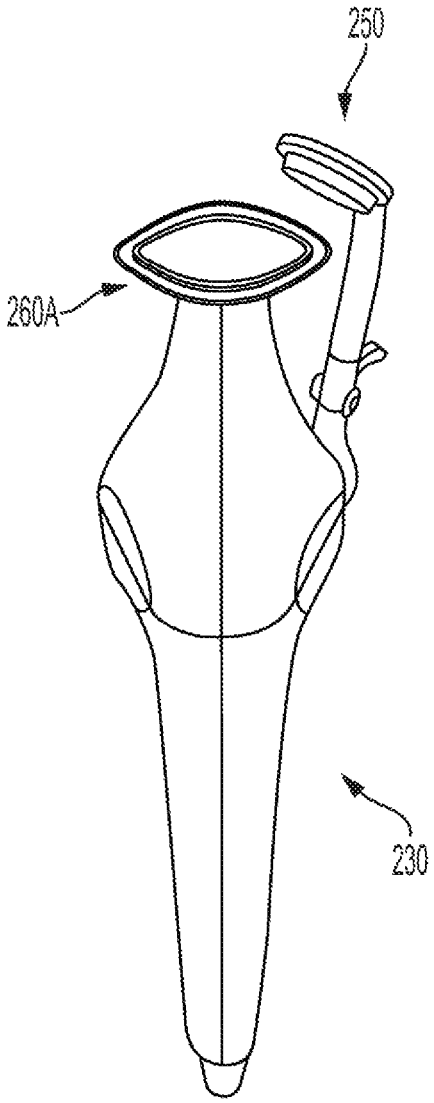
FIGS. 30A and 30B are front perspective views of the cosmetic applicator of FIGS. 24A-C illustrating respective positions of its movable element according to an exemplary embodiment of the invention.
Figure 30B:
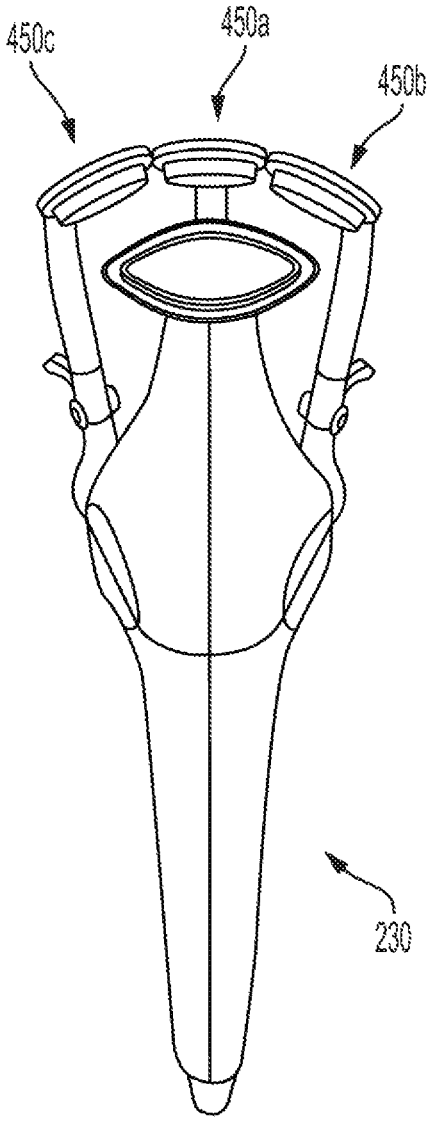

FIGS. 30A and 30B are front perspective views of cosmetic applicator 230 for illustrating respective positions of movable element 250 according to an exemplary embodiment of the invention. As described above, movable element 250 may be moved from side to side along elongate opening 280 in main body 240 of cosmetic applicator 230 by, for example, applying a force on tab element 258. FIG. 30A shows a position of movable element 250 when it is moved to one side in this manner. Correspondingly, FIG. 30B illustrates a center position 450*a* corresponding to a default position illustrated in FIGS. 24A to 27B, along with a side position 450*b* corresponding to FIG. 30A and an opposite side position 450*c*. Accordingly, movable element 250 may be moved back and forth between positions 450*b* and 450*c* in a smooth and steady manner in order to accurately and repeatably apply cosmetics, say, in the manner illustrated in FIGS. 17-20. For example, main applicator 260A may be placed over an eyelid of the user to serve as a stationary anchor for applicator 230. Accordingly, movable element 250 may be moved along a substantially arced path from position 450*b* to position 450*c*, and/or vice versa, in order to apply cosmetics to the user's eyelid region 9 along a substantially arced path that would correspond to a natural or artificial crease line 13. Advantageously, applicator 230 provides for an anchored application of cosmetics along a defined path of the applicator 230 so that a user can reliably apply cosmetics along a desired path—for example, to create an artificial crease line and/or to supplement a natural or artificial crease line—without requiring undue user expertise. In other words, cosmetics may be applied accurately and repeatedly by moving movable element 250 from position 450*b* to 450*c*, and/or vice versa, at a desired pivot height between the positions of applicator head 251 shown in FIGS. 27A and 27C.

According to an exemplary embodiment of the invention, a range of movement between positions 450*b* and 450*c* may span an arc of up to and including about 90 degrees—preferably between about 25 degrees and about 40 degrees—for a plane approximating a cosmetic application surface of applicator head 251 (or an orthogonal axis extending therefrom). For example, main applicator 260A may be placed on a principal location on an eyelid, such as eyelid area 9, and movable element 250 may be moved back and forth between positions 450*b* and 450*c* so that applicator head 251 may apply cosmetics to create an eyelid crease that corresponds to or simulates a natural crease 13 along with creating a so-called "smokey eye" effect. Advantageously, the stabilized and repeatable movement of movable element 250 provides the user with a more convenient process of applying cosmetics in this manner without undue expertise.

Cosmetic application 230 may be made with a thermoplastic or composites thereof, or any material with sufficient strength and rigidity for cosmetic applications—for example, various kinds of metals, alloys, and the like.

It will further be appreciated by one of ordinary skill in the art that coupling 297 may be replaced with alternative means for attaching and detaching applicator head 251 to cosmetic applicator 230 in forming movable element 250. For example, coupling 297 may comprise threads for a screw-on and rotatable coupling.

Figure 31:
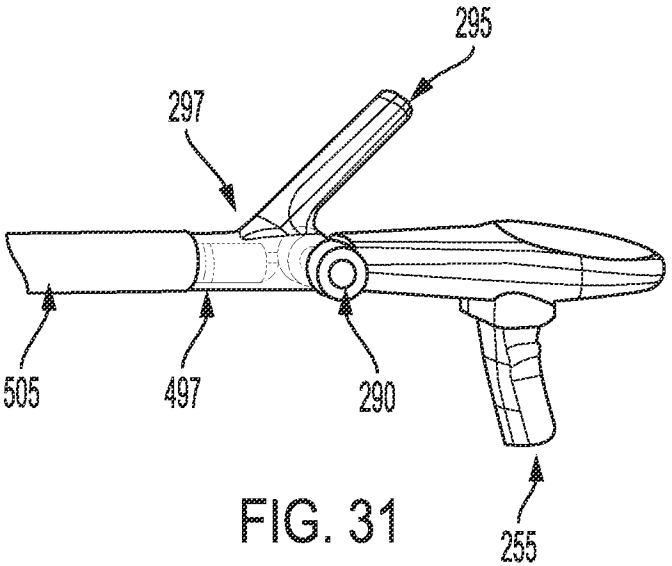
FIG. 31 is a diagram illustrating a detachable coupling of the movable member according to an exemplary embodiment of the invention.

FIG. 31 is a diagram illustrating detachable coupling 297 of movable member 250 according to an exemplary embodiment of the invention. In FIG. 31, shaft 295 is shown in transparency to illustrate its internal configuration in coupling to hinge 290 and coupling 297, respectively. As shown in FIG. 31, shaft 295 may be integrated with an opening towards a front end (towards applicator head 251) for accommodating an insertion element for attaching shaft 505, which is coupled to applicator head 251, thereto. According to an exemplary embodiment of the invention, the insertion element of shaft 505 may comprise a raised portion 497 having a larger diameter than the remainder of the insertion element. Correspondingly, the front-end opening of shaft 295 may comprise a channel for receiving the raised portion 497 in order to hold shaft 505 in place when it is coupled to shaft 295. As further shown in FIG. 31, shaft 295 may be connected to attachment arm 255 via hinge 290 so that a user may push down (e.g., with a finger or thumb) on shaft 295 to pivot applicator head 251 upward away from main applicator 260A—for example, as shown in FIGS. 27A and 27B.

Figure 32B:
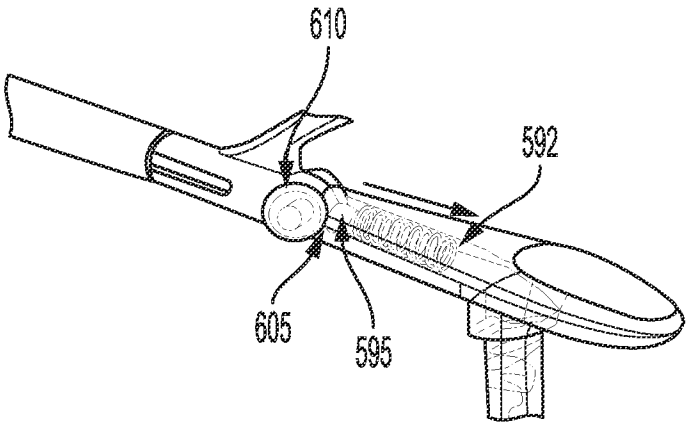
FIGS. 32A and 32B are diagrams showing details related to a hinge of the movable member in accordance with an exemplary embodiment of the invention.
Figure 32A:
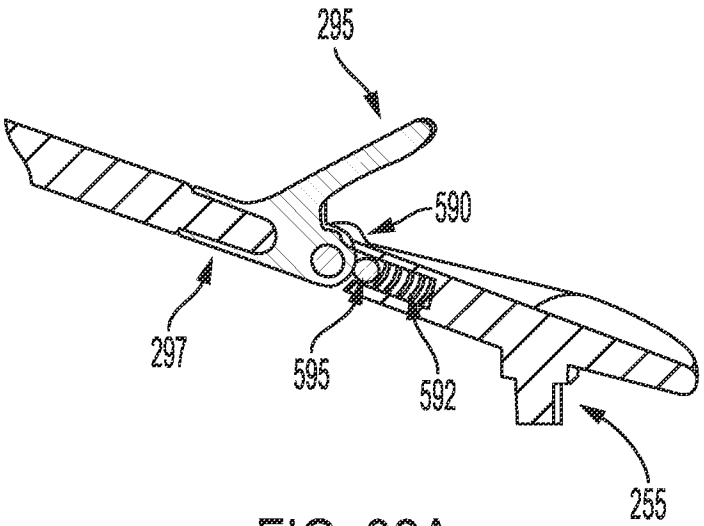

FIGS. 32A and 32B are diagrams showing details related to hinge 290 in accordance with an exemplary embodiment of the invention. FIG. 32A is a cross-sectional view of hinge 290 for illustrating the internal elements thereof. As shown in FIG. 32A, hinge 290 may comprise a back surface 590 facing an internal channel for accommodating a resilient member (such as a spring) 592 that exerts a force on a friction-and-catch member 595 against back surface 590. Accordingly to an exemplary embodiment of the invention, friction-and-catch member 595 may be a ball-bearing, and the like, that exerts sufficient frictional force against back surface 590 so that movable element 250 can retain any position between the lowered position shown in FIG. 24A and the fully pivoted position shown in FIGS. 27A and 27B. Accordingly, a user may adjust the arc of the cosmetics being applied using the back—and forth motion illustrated in FIG. 30B by adjusting the height of the pivot of movable element 250 and, correspondingly, the height of applicator head 251 from main applicator 260A.

As illustrated in FIG. 32B, back surface 590 may incorporate a notch 605 for receiving friction-and-catch element 595 (e.g., ball bearing) when movable element 250 is placed in the lowered position shown in FIG. 24A. As resilient member 592 exerts a force on a back wall of its internal channel and on the friction-and-catch element 595, movable element is held in place in the lowered position shown in FIG. 24A. Correspondingly, back surface 590 may incorporate another notch, for example, at a location indicated by reference numeral 610. Accordingly, when movable element 250 is pivoted and raised to the fully pivoted position shown in FIGS. 27A and 27B, friction-and-catch element 595 is fitted at least partially into notch 610. As resilient member 592 exerts a force on a back wall of its internal channel and on the friction-and-catch element 595, movable element is held in place in the fully pivoted position shown in FIGS. 27A and 27B. A movement range of movable element 250 is thereby defined for the user to improve usability and durability of cosmetic applicator 230.

As described above, all of the applicators in cosmetic applicator 230—for example, applicator head 251, main applicator 260A, and secondary applicator 260B—may be replaceable with any kind, shape, or sort as discussed herein without limitation, for example the use of a brush, a foam pad, and differently shaped foam members and differently shaped brushes. For example, applicator head 251 may be replaced with another element having a different length (e.g., of shaft 505), size, shape, kind, or sort by attaching such a different element at coupling 297.

Figure 33B:
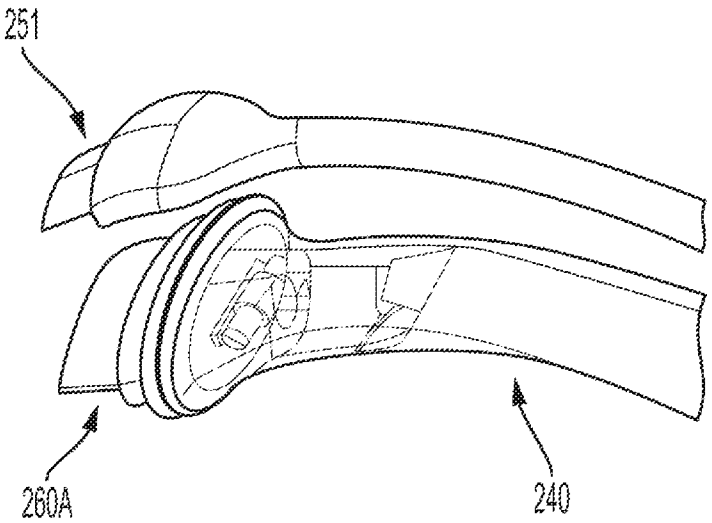
FIGS. 33A and 33B are diagrams illustrating a detachable and replaceable main applicator in accordance with an exemplary embodiment of the invention.
Figure 33A:
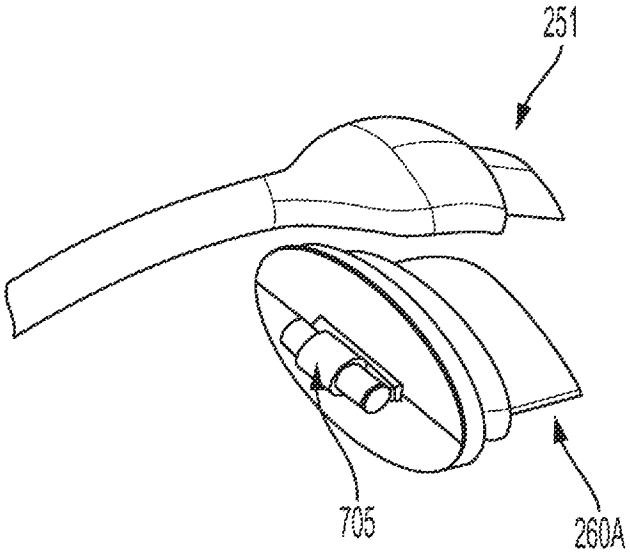

FIGS. 33A and 33B are diagrams illustrating a detachable and replaceable main applicator 260A in accordance with an exemplary embodiment of the invention. As shown in FIGS. 33A and 33B, main applicator 260A may incorporate an attachment element 705 for detachably coupling to main body 240 of cosmetic applicator 230—e.g., top portion 242*b* illustrated in FIGS. 29A and 29B. According to an exemplary embodiment of the invention, attachment element 705 comprises two ends at which corresponding wrapping hooks (not shown) incorporated in the top portion 242*b* grips the attachment element 705. The user may, therefore, replace main applicator 260A with another different applicator element having a similar attachment element 705 for coupling to cosmetic applicator 230.

In the present text, numerous specific details were set forth in order to provide a more thorough understanding of exemplary versions of the present invention. It will be apparent, however, to one skilled in the art, that some versions of the present invention may be practiced without some of these specific details while remaining within the scope and spirit of the present invention. Indeed, reference in this specification to "a variant," "variants," and "one/the variant," or "one version," "a version" or "an embodiment" and the like, should be understood to mean that a particular feature, structure, or characteristic described in connection with the variant or version is included in at least one such variant or version according to the disclosure. Thus, the appearances of phrases such as "in one variant," "in one embodiment," "in one version," and the like, in various places in the specification are not necessarily all referring to the same version or variant, nor are separate or alternative versions or variants mutually exclusive of other versions or variants. Moreover, various features may be described which possibly may be exhibited by some variants or versions and not by others. Similarly, various requirements are described which may be requirements for some variants or versions, but not others. Furthermore, as used throughout this specification, the terms 'a', 'an', 'at least' do not denote a limitation of quantity, but rather denote the presence of at least one of the referenced item, in the sense that singular reference of an element does not necessarily exclude the plural reference of such elements. Concurrently, the term "a plurality" denotes the presence of more than one referenced items. Finally, the terms "connected" or "coupled" and related terms are used in an operational sense and are not necessarily limited to a direct connection or coupling.

As an example, while a cosmetic applicator (e.g., 230) has been described with one movable element (e.g., 250) comprising a corresponding applicator head (e.g., 251), it should be understood by one of ordinary skill in the art that additional elements, such as an additional movable element and/or applicator head, may be incorporated in a cosmetic applicator without departing from the scope and spirit of the invention. As an example, plural applicator heads may be aligned (or "stacked") with one another—in addition to elements 251 and 260A described above and shown in FIG. 27A—for applying a blend of multiple bands of cosmetics.

Various operations may be described as multiple discrete operations in turn, in a manner that may be helpful in understanding embodiments of the present invention; however, the order of description should not be construed to imply that these operations are order dependent.

Those of skill in the related arts will understand that as used herein there is no particular limitation on the positioning support systems, apparatus, construction, linkages or otherwise to those embodiments suggested herein. As a result, those of skill in the art will recognize that interchanging or replacing or supplementing the related structures, features, and systems herein will be within the scope and spirit of the present invention.

Those of skill in the related arts will also recognized that as used herein a cosmetic system or kit or assembly thereof is illustrative of the alternative and adaptive combinations of the present invention and all such variants should be recognized as being within the scope and spirit of the present invention.

Those of skill in the cosmetic arts will also understand that as used herein there is no limitation on the type of skin-contact end of the application member, which may be selected from any tip type known in the conventional arts for applying makeup to the user, including but not limited to a roller ball construction, a fibrous-brush member, a pad member constructed of felt, foam, or textile or any combination, a felt-tip or flair-tip end allowing dyed fluid application, a sharpened-tip (e.g., a rigid end applying a solid or semi-solid material contained in the application member).

Those of skill in the cosmetic arts will further understand that as used herein the invention, apparatuses, methods, and alternative embodiments may be used for applying cosmetics to eye lids, eye brows, crease regions, eye upper folds, lower eye folds, or any combination or arrangement relating to a user's facial structure without departing from the scope and spirit of the present invention.

As used herein the phrase 'lateral' generally refers to a side-type direction, preferably (but not required to be) in a direction away from midline 14, whereas the phrase 'medial' generally refers to a similar side-type direction, preferably (but not required to be) in a direction toward midline 14. As a result, a movement from an inner edge 4*a* of an eye 4 laterally (away from midline 14) toward outer edge 4*b* is a 'lateral' motion and the opposite direction is a medial motion or in a medial direction.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. A cosmetic applicator device, comprising:

an elongate body having a length with a longitudinal axis through the length of the elongate body, a width, and at most two ends;

a first cosmetic applicator on one end of the elongate body, the first cosmetic applicator being centered on the longitudinal axis of the elongate body; and a movable element having two ends, where a first end of the movable element is coupled to the elongate body, and a second end of the movable element comprises a second cosmetic applicator, wherein the elongate body comprises an opening across the width of the elongate body that defines an extent of a movement path of the movable element, wherein the opening is perpendicular to the longitudinal axis of the elongate body;

the movable element is movable along the width of the elongate body within the opening to allow movement of the second cosmetic applicator in an arced path around the longitudinal axis of the elongate body so that the entire second cosmetic applicator is movable to either side of the longitudinal axis of the elongate body;

and the movable element further comprises a hinge and a thumb press structure exterior to the elongate body configured to pivot the second cosmetic applicator in a plane perpendicular to the movement path of the movable element between a first position proximate the first cosmetic applicator and a second position away from the first cosmetic applicator.

2. The cosmetic applicator device of claim 1, wherein the movable element coupled to the elongate body is movable across the opening across the width of the elongate body in the arced path around a fulcrum in the elongate body.

3. The cosmetic applicator device of claim 2, wherein the first end of the movable element is coupled to the elongate body at the fulcrum.

4. The cosmetic applicator device of claim 1, wherein the movable element comprises a rotatable coupling configured to rotate the second cosmetic applicator.

5. The cosmetic applicator device of claim 1, further comprising a third cosmetic applicator on an opposite end of the elongate body from the first cosmetic applicator.

6. The cosmetic applicator device of claim 5, wherein the third cosmetic applicator comprises a blender brush.

7. The cosmetic applicator device of claim 1, wherein one or more of the first and second cosmetic applicators are detachably coupled to the cosmetic applicator device.

8. The cosmetic applicator device of claim 1, wherein a portion of the movable element is rotatable for orienting the second cosmetic applicator.

9. A cosmetic applicator device, comprising:

an elongate body having a length with a longitudinal axis through the length of the elongate body and a width;

a first cosmetic applicator on one end of the elongate body, the first cosmetic applicator being centered on the longitudinal axis of the elongate body; and a movable element coupled to the elongate body, the movable element comprising a second cosmetic applicator, wherein the movable element is coupled to the elongate body at a fulcrum and is pivotable around the fulcrum, wherein the movable element comprises an attachment arm that comprises a cylindrical element on an end of the attachment arm, wherein the cylindrical element is configured to engage a corresponding structure internal to the elongate body to provide the movable element with a fulcrum for pivoting the movable element;

the elongate body comprises an opening across its width that defines an extent of a movement path of the movable element when pivoted around the fulcrum, wherein the movable element is movable along the width of the elongate body within the opening to allow movement of the second cosmetic applicator in an arced path around the longitudinal axis of the elongate body so that the entire second cosmetic applicator is movable to either side of the longitudinal axis of the elongate body;

and the movable element further comprises a hinge and a thumb press structure exterior to the elongate body configured to pivot the second cosmetic applicator in a plane perpendicular to the movement path of the movable element between a first position proximate the first cosmetic applicator and a second position away from the first cosmetic applicator.

10. The cosmetic applicator device of claim 9, wherein the movable element comprises a rotatable coupling configured to rotate the second cosmetic applicator.

11. The cosmetic applicator device of claim 9, further comprising a third cosmetic applicator on an opposite end of the elongate body from the first cosmetic applicator.

12. The cosmetic applicator device of claim 11, wherein the third cosmetic applicator comprises a blender brush.

13. The cosmetic applicator device of claim 9, wherein one or more of the first and second cosmetic applicators are detachably coupled to the cosmetic applicator device.

14. The cosmetic applicator device of claim 9, wherein a portion of the movable element is rotatable for orienting the second cosmetic applicator.

15. A cosmetic applicator device, comprising:

an elongate body having a length with a longitudinal axis through the length of the elongate body and a width;

a first cosmetic applicator on one end of the elongate body; and a movable element having two ends, where a first end of the movable element is coupled to the elongate body, and a second end of the movable element comprises a second cosmetic applicator, wherein the elongate body comprises an opening across the width of the elongate body that defines an extent of a movement path of the movable element, wherein the width of the elongate body is greater in the region of the opening and tapers in either longitudinal direction towards the ends of the elongate body;

the movable element is movable along the width of the elongate body within the opening;

the second cosmetic applicator is moved in an arced path when the movable element coupled to the elongate body is moved across the opening across the width of the elongate body so that the second cosmetic applicator is movable to either side of the longitudinal axis of the elongate body;

and the movable element further comprises a hinge and a thumb press structure exterior to the elongate body configured to pivot the second cosmetic applicator in a plane perpendicular to the movement path of the movable element between a first position proximate the first cosmetic applicator and a second position away from the first cosmetic applicator.

16. The cosmetic applicator device of claim 15, further comprising a third cosmetic applicator on an opposite end of the elongate body from the first cosmetic applicator.

17. The cosmetic applicator device of claim 16, wherein the third cosmetic applicator comprises a blender brush.

18. The cosmetic applicator device of claim 15, wherein one or more of the first and second cosmetic applicators are detachably coupled to the cosmetic applicator device.

19. The cosmetic applicator device of claim 15, wherein a portion of the movable element is rotatable for orienting the second cosmetic applicator.

* * * * *